US007783423B2

(12) United States Patent
Verma et al.

(10) Patent No.: US 7,783,423 B2
(45) Date of Patent: Aug. 24, 2010

(54) POSITION DETERMINATION SYSTEM AND METHOD

(75) Inventors: Rajiv Kumar Verma, Milpitas, CA (US); Clifford Chow, Sunnyvale, CA (US); Gregory T. Janky, Sammamish, WA (US); Dennis Workman, Morgan Hill, CA (US)

(73) Assignee: Trimble Navigation Limited, Sunnyvale, CA (US)

( * ) Notice: Subject to any disclaimer, the term of this patent is extended or adjusted under 35 U.S.C. 154(b) by 1050 days.

(21) Appl. No.: 11/495,439

(22) Filed: Jul. 28, 2006

(65) Prior Publication Data

US 2010/0149030 A1 Jun. 17, 2010

Related U.S. Application Data

(63) Continuation-in-part of application No. 10/392,995, filed on Mar. 19, 2003, now Pat. No. 7,050,907, which is a continuation-in-part of application No. 10/222,532, filed on Aug. 15, 2002, now Pat. No. 6,801,853.

(51) Int. Cl.
*G01C 21/26* (2006.01)

(52) U.S. Cl. ..... 701/213; 701/214; 701/219; 340/989

(58) Field of Classification Search ..... 701/207, 701/208, 213, 209, 214–219, 21, 300, 301; 340/989, 992, 993; 342/357.01, 357.06, 342/357.08, 457; 455/456.1–456.6
See application file for complete search history.

(56) References Cited

U.S. PATENT DOCUMENTS

| | | | |
|---|---|---|---|
| 5,491,486 | A | 2/1996 | Welles, II |
| 5,650,770 | A | 7/1997 | Schlager et al. |
| 5,917,405 | A | 6/1999 | Joao |
| 6,046,687 | A | 4/2000 | Janky |
| 6,356,196 | B1 | 3/2002 | Wong et al. |
| 6,362,736 | B1 | 3/2002 | Gehlot |
| 6,377,165 | B1 | 4/2002 | Yoshioka et al. |
| 6,505,049 | B1 | 1/2003 | Dorenbosch |
| 6,512,465 | B2 | 1/2003 | Flick |
| 6,609,064 | B1 | 8/2003 | Dean |
| 6,657,587 | B1 | 12/2003 | Mohan |
| 6,658,349 | B2 | 12/2003 | Cline |
| 6,700,762 | B2 | 3/2004 | Underwood et al. |
| 6,801,853 | B2 | 10/2004 | Workman |
| 6,804,602 | B2 | 10/2004 | Impson et al. |

(Continued)

FOREIGN PATENT DOCUMENTS

| | | |
|---|---|---|
| GB | 2373086 | 9/2002 |
| JP | 8240653 | 9/1996 |
| JP | 2000048283 | 2/2000 |
| JP | 2000249752 | 9/2000 |

(Continued)

OTHER PUBLICATIONS

"Highland Man's Invention Success With Dewalt", http://www.heraldextra.com/content/view/195674/4/, Oct. 8, 2006,3.

*Primary Examiner*—Richard M. Camby

(57) ABSTRACT

An improved position determination system and method are described. The method includes determining that a failure to generate an acceptable GNSS position fix has occurred. In response to determining that the failure to generate an acceptable GNSS position fix has occurred, terrestrial positioning information is accessed which is derived from at least one broadcast signal. A second position fix based upon the terrestrial positioning information is generated.

34 Claims, 20 Drawing Sheets

U.S. PATENT DOCUMENTS

| | | | | |
|---|---|---|---|---|
| 6,864,789 | B2 | 3/2005 | Wolfe | |
| 7,050,907 | B1 | 5/2006 | Janky et al. | |
| 7,313,476 | B2 | 12/2007 | Nichols et al. | |
| 7,639,181 | B2 * | 12/2009 | Wang et al. | 342/357.12 |
| 7,667,642 | B1 * | 2/2010 | Frericks et al. | 342/357.07 |
| 2002/0070856 | A1 | 6/2002 | Wolfe | |
| 2004/0034470 | A1 | 2/2004 | Workman | |
| 2005/0030175 | A1 | 2/2005 | Wolfe | |
| 2005/0179541 | A1 | 8/2005 | Wolfe | |

FOREIGN PATENT DOCUMENTS

| | | |
|---|---|---|
| JP | 2002197593 | 7/2002 |
| JP | 2002197595 | 7/2002 |
| JP | 2002217811 | 8/2002 |
| WO | WO 0235492 | 5/2002 |
| WO | WO-03/007261 | 1/2003 |
| WO | WO 2004/017272 | 2/2004 |
| WO | WO-2004017272 | 2/2004 |
| WO | WO 2004/083888 | 9/2004 |
| WO | WO/2005/017846 | 2/2005 |

* cited by examiner

POSITION DETERMINATION SYSTEM AND METHOD

RELATED U.S. APPLICATION

The present invention is a Continuation-in-Part of U.S. utility patent application Ser. No. 10/392,995, filed Mar. 19, 2003 by Gregory T. Janky, Dennis Workman and Ami Bergstrom entitled A Method and System for Controlling an Electronic Device, now U.S. Pat. No. 7,050,907, which is a Continuation-in-Part of application Ser. No. 10/222,532, now U.S. Pat. No. 6,801,853 issued Oct. 5, 2004 and filed Aug. 15, 2002, entitled A Portable Motion-Activated Position Reporting Device by Dennis Workman, both of which are assigned to the assignee of the present invention, both of which are hereby incorporated herein by reference in their entirety.

TECHNICAL FIELD

Embodiments of the present invention are related to improving position determination of a device used for reporting the position of a person or object, and for providing control information.

BACKGROUND

Position reporting devices are frequently used to locate and report the position of a person or object. A typical position reporting device combines a navigation system such as a Global Positioning System (GPS) module with a mobile communications system such as a cellular modem to determine the position or geographic location of a person or an asset being tracked and report its position to a tracking facility. Position reporting devices are used in a variety of systems in which timely position information is required such as fleet tracking and asset recovery systems.

Fleet tracking systems allow a user to monitor the position of a vessel or vehicle carrying a position reporting device. For example, the course of a vehicle being tracked can be inferred using successive position fixes sent by the position reporting device. The phrase "position fix" refers to a process of determining an unknown location using a fixed reference point or points. In a similar manner it can be inferred that the vehicle is not moving when successive position fixes report the same position. Fleet tracking systems are commonly used by delivery services for the routing and dispatching of vehicles. Asset recovery systems report the position of stolen or missing property (e.g., a stolen car) to a service provider or to the police in order to facilitate recovering the property.

However, many potential users find the cost of position reporting devices prohibitive compared to the value of the asset being tracked. Many position reporting devices have a manufacturing cost in the range of $200-$300 and a market price in the range of $500-$600. Thus, the use of position reporting devices has typically been limited to high value items such as cars or other vehicles.

Another drawback associated with position reporting devices is the amount of power they consume. While battery powered position reporting devices do exist, the amount of power they consume when turned on necessitates frequent battery changes in order to continue operating. This makes using position reporting devices inconvenient to some users in that they require an excessive amount of maintenance to continue operating.

Moreover, many position reporting devices utilize information that they access from satellite based positioning systems such as GPS. While satellite based positioning works very well in open space locational environments, some devices face constraints in achieving a valid and reliable (e.g., accurate, precise, etc.) geographic position fix using satellite based position information in environments other than such open spaces. For instance, when operated in a dense, urban cityscape type environment, it can be difficult for some devices to achieve a valid satellite based position fix. While some of these devices can eventually arrive at a valid geographic fix solution based exclusively on satellite based locational information, achieving it can be costly in terms of computational and/or networking resource usage and/or power consumption. Where a valid fix can be achieved under such constraints, calculating the solutions to achieve the fix can require an inordinate amount of time. This can be unacceptable in some situations.

SUMMARY

Accordingly, a need exists for a low-cost portable position determining and/or reporting device which is small enough to be easily concealed upon an asset which is being tracked. While meeting the above need, a further need exists for a method for reducing the power consumption of the above stated device. Additionally, while meeting the above stated needs, it would be advantageous to provide a device which can control functionality and operational performance on the basis of achieving a valid and reliable geographic position fix on the basis of locational information provided in addition to satellite based position information.

In one embodiment, the method includes detecting a motion of the electronic device. In one embodiment, a signal corresponding to the motion detection is latched and the motion detection is validated as significant to the electronic device. A satellite based position determining component then attempts to determine the position of the electronic device in response to that motion detection. In one embodiment, satellite based position information from at least one Global Navigation Satellite Service (GNSS) satellite based positioning system is used. Typically, the satellite based position determination is not performed unless the motion is so validated.

In embodiments of the present invention, if an acceptable position fix has not been achieved using the satellite based position determining component, a second position determining component is then used to determine a position fix. The second position determining component uses terrestrially generated broadcast signals which are typically generated from fixedly located transmitters. The broadcast signals may comprise television signals and in one embodiment, a source of the terrestrial based position information incorporates Rosum Positioning Technology™ (RPT™). In one embodiment, the second position determining component derives pseudoranges from the fixedly located transmitters. Thus, in embodiments of the present invention, determining a position fix for the electronic device may be based upon the satellite based position determining component, or the terrestrial based position determining component.

In one embodiment, the method further includes programming a device controller with a location, or a geo-temporal zone, and selecting a device function there for. A device state, which includes the device position, is then monitored. Upon determining that the device state corresponds with the defined location or geo-temporal zone, the device may be controlled to execute the selected function. The selected function can relate to, for example, selectively enabling or disabling some or all of the device capabilities, power management, and others.

BRIEF DESCRIPTION OF THE DRAWINGS

The accompanying drawings, which are incorporated in and form a part of this specification, illustrate embodiments of the present invention and, together with the description, serve to explain the principles of the invention. Unless specifically noted, the drawings referred to in this description are not drawn to scale.

DETAILED DESCRIPTION

Figure 1:
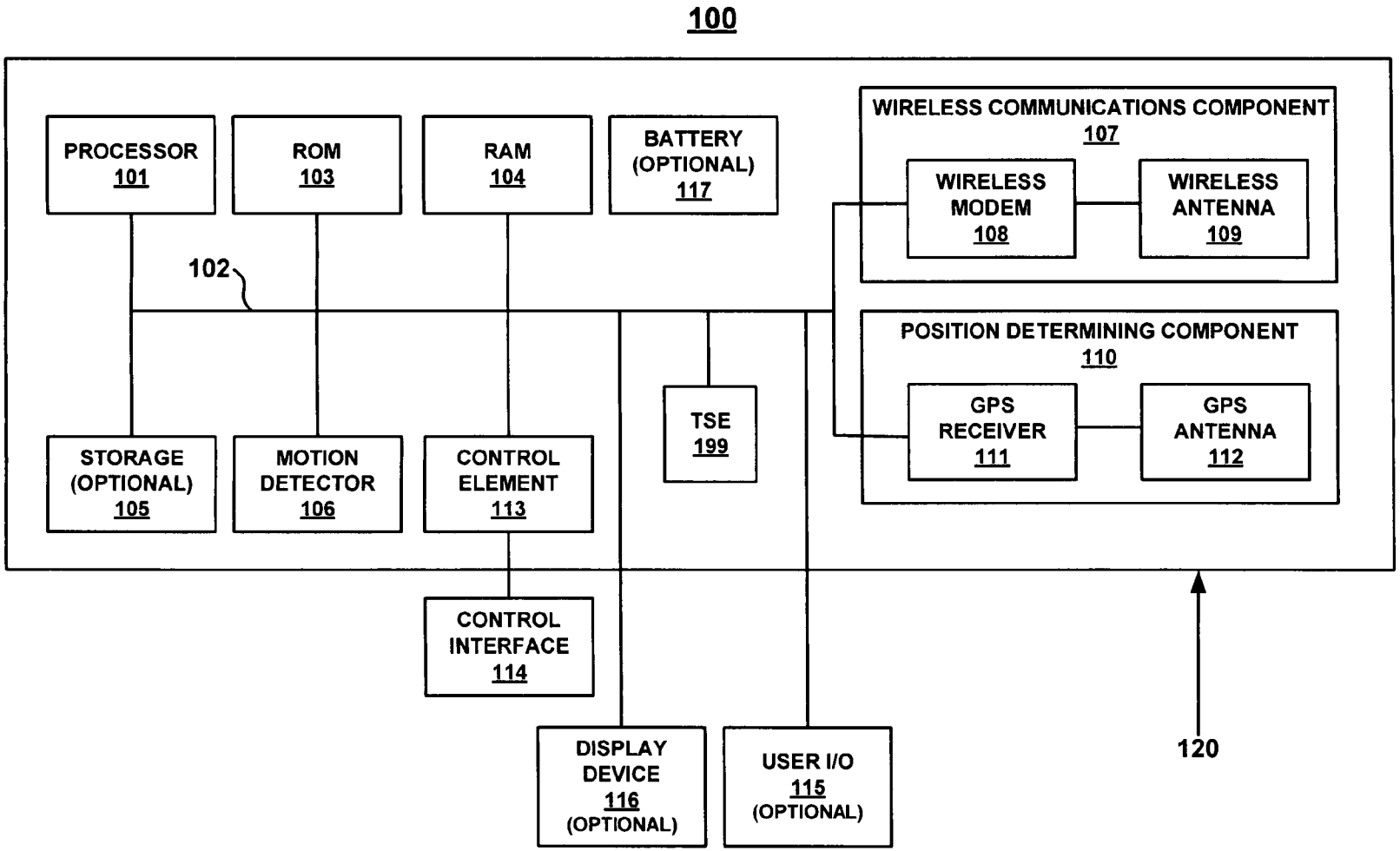
FIG. 1 depicts an exemplary initiating component, according to an embodiment of the present invention.

An improved position determination system and method for an electronic device, and a controllable electronic device are described herein. Reference will now be made in detail to embodiments of the present invention, examples of which are illustrated in the accompanying drawings. While the present invention will be described in conjunction with the following embodiments, it will be understood that they are not intended to limit the present invention to these embodiments alone. On the contrary, the present invention is intended to cover alternatives, modifications, and equivalents which may be included within the spirit and scope of the present invention as defined by the appended claims. Furthermore, in the following detailed description of the present invention, numerous specific details are set forth in order to provide a thorough understanding of the present invention. However, embodiments of the present invention may be practiced without these specific details. In other instances, well-known methods, procedures, components, and circuits have not been described in detail so as not to unnecessarily obscure aspects of the present invention.

Embodiments of the present invention relate to a method and system for improving the sensitivity of a positioning system used with an electronic device. Embodiments of the present invention may be used to monitor the position of an electronic device and to generate commands for causing the device to automatically perform a designated action based upon its geographic location, or its geo-temporal location. Embodiments of the present invention can also be used to detect and report unauthorized movement of the electronic device and to assist in recovering it when unauthorized movement occurs.

Embodiments of the present invention comprise an initiating component disposed in an electronic device. The initiating component utilizes a motion detecting component which detects movement of the electronic device and sends a signal to a controller. In response to receiving this signal, the controller initiates a position determining component to determine the geographic location of the electronic device. This extends the battery life of the electronic device because the initiating component draws a minimal amount of power until movement of the device is detected. In one embodiment, the geographic location is compared with the coordinates of predefined zones. Based upon the zone in which the electronic device is present, e.g., spatially or spatially and temporally, the controller generates a command for causing the electronic device to perform a specific action.

Embodiments of the present invention utilize a geo-fencing system in which a set of position coordinates is provided which defines a pre-defined zone. In embodiments of the present invention, upon entering or leaving a pre-defined zone, a command is generated for causing the electronic device to perform a particular task. For example, the present invention can be configured to automatically shut down the electronic device when a particular zone is entered and to automatically activate the electronic device when that zone is left. In another embodiment, the position coordinates define a zone within which the asset can be moved without triggering an alarm. When the electronic device is moved outside of that zone, it sounds an audible alarm until deactivated. Alternatively, a wireless message can be sent to a monitoring service that notifies the owner of the device and/or law enforcement agencies in order to facilitate recovering the electronic device. Similarly, embodiments of the present invention can be used to cause an electronic device to perform a particular task when it is moved outside of a designated geographic zone.

In some embodiments, a method and/or system effectively controls an electronic device. The method includes programming a device controller with a location and selecting a device function there for. A device state, which includes the device position, is then monitored with a combination of satellite (e.g., GNSS, etc.) and/or terrestrial based position determination, which is based on monitoring signals from fixedly located broadcast (e.g., TV, etc.) transmitters. Where an acceptable satellite based fix cannot be achieved, the corresponding terrestrial based information is accessed and a position fix determined therewith. Upon determining that the device state corresponds with the defined geo-temporal zone, the device is controlled to execute the selected function. The function can relate to selectively enabling or disabling some or all of the device capabilities, power management, and others.

Therefore, a portable electronic device is controlled according to its presence within a pre-definable geographic zone without constraint by attempting to achieve a valid, reliable position fix in other than open space environments using only satellite based positioning information. The location of the device within this zone is determined with a positioning system, which utilizes satellite based positioning information and/or terrestrially generated positioning information. Thus, the electronic device is effectively controlled upon entry within a pre-defined geo-temporal zone, which can include dense, urban cityscapes and similarly cluttered landscapes and environments and within building enclosures, with valid, reliable position fixes achieved therein. This capability allows the device to be selectively enabled or disabled according to its relation with the geographic zone, to perform certain power management functions, and to operate in a designated mode on the basis of reliable, valid determination of its spatial presence within the geographic zone.

Methods and systems of embodiments of the present invention can be implemented in a variety of different geopositioning, geo-temporal control, network and/or computer systems. In embodiments of the present invention, geopositioning determination may be based on, for example, GNSS, or similar zone based, or geo-temporal zone based, control systems. One exemplary embodiment of the present invention includes a control system for an electronic device, which effectively integrates a geopositioning system based on GNSS or similar technologies with a geopositioning sub-system based on, for example, signals received from television (TV) towers. The description of these exemplary positioning systems and methods according to embodiments of the present invention commences with Section II at FIG. 9 herein. Presented first, Section I with FIGS. 1-8 represent a discussion of exemplary methods and systems for determining the position of an electronic device to provide context for the discussion the exemplary systems and methods used in embodiments of the present invention

Section I

An Exemplary System and Method for Controlling an Electronic Device

Exemplary Initiating Component

FIG. 1 depicts an exemplary initiating component 100, according to an embodiment of the present invention. Initiating component 100 comprises a processor 101 coupled with an address/data bus 102. Processor 101 is for processing digital information and instructions and bus 102 is for conveying digital information between the various components of initiating component 100. Also coupled with bus 102 is a non-volatile read only memory (ROM) 103 for storing information and instructions of a more permanent nature, and a random access memory (RAM) 104 for storing the digital information and instructions of a more volatile nature. In addition, initiating component 100 may optionally include a data storage device 105 for storing vast amounts of data. In embodiments of the present invention, data storage device 105 may comprise a removable storage medium such as a smart card or an optical data storage device. Alternatively, data storage device 105 may comprise a programmable data storage device such as a flash memory device to facilitate quickly updating data. It should be noted that instructions for processor 101 as well as position coordinates which define a pre-defined zone, previously determined geographic locations and/or pseudo ranges of initiating component 100, previously sampled GNSS signals, and configuration data for determining what action should be initiated depending upon the current time and/or location of initiating component 100, can be stored either in volatile memory 104, data storage device 105, or in an external storage device (not shown).

Initiating component 100 also comprises a time sensitive element (e.g., component, device, etc.) 199. In one embodiment, time sensitive element 199 is disposed within processor 101. For instance, in one embodiment, time sensitive element 199 comprises the real time clock with which processor 101 operates. In one embodiment, time sensitive element 199 comprises a device, such as a real time clock, a crystal oscillator, etc., coupled to processor 101 with bus 102, which can function in conjunction with or independently of a clock or processor 101. In one embodiment, time sensitive element 199 is operable with wireless communications component 107, I/O 115, and/or position determining component 110 for time checking, updating, synchronizing, adjusting, etc., with a source of reliable time signals such as may be associated with and/or promulgated, e.g., wirelessly, telephonically, etc., by a geopositioning entity, a network or communication entity, a standard time source such as is maintained (e.g., operated, promulgated, etc.) by the National Institute for Standards and Technology (NIST) of the U.S. Department of Commerce or another government, scientific, commercial or other time reporting entity.

Initiating component 100 further comprises a motion detector 106 coupled with bus 102 for detecting changes in the motion state of initiating component 100. In one embodiment, motion detector 106 detects the vibration associated with the movement of initiating component 100 and indicates this movement to processor 101 when changes in the vibration of initiating component 100 are detected. In other embodiments of the present invention, motion detector 106 may be a magneto-restrictive motion detector (MRMD), an acceleration sensor (e.g., accelerometer), a tilt sensor, a rotation sensor, a gyroscope, etc. However, while the present embodiment recites these particular implementations of motion detector 106, the present invention is well suited to utilize a variety of devices for detecting movement of initiating component 100 and for indicating this movement to processor 101. A MRMD used in one implementation comprises a device similar to those provided by Honeywell, Inc., a corporation in Morristown, N.J. MRMDs typically operate according to principles explained in a paper entitled "A New Perspective on Magnetic Field Sensing," by T. Bratland, M. J. Caruso, C. H. Smith and R. Schneider (1998), which is available from Honeywell, Inc., and which is incorporated herein in its entirety by reference.

In accordance with embodiments of the present invention, motion detector 106 detects when initiating component 100 transitions from a substantially stationary state to a moving state. Motion detector 106 can also detect when initiating component 100 transitions from a moving state to a substantially stationary state. Thus, in embodiments of the present invention, motion detector 106 detects changes in the state of motion of initiating component 100 such as starting or stopping of motion and generates an interrupt to processor 101. In response to these changes in motion, an interrupt is generated by motion detector 106. In response to an interrupt from motion detector 106, processor 101 changes the operating state of initiating component 100 from an idle operating state, in which a few components of initiating component 100 (e.g., wireless communications component 107 and position determining component 110) draw a minimal amount of power, to an active operating state in which the initiating component 100 draws additional power.

A wireless communications component 107, comprising a wireless modem 108 and a wireless antenna 109, is coupled with bus 102. A position determining component 110, comprising a GNSS receiver 111 and a GNSS antenna 112, is also coupled with bus 102.

Wireless communications component 107 is for transmitting and receiving wireless messages (e.g., data and/or commands). In one embodiment, wireless communications component 107 is comprised of a cellular wireless antenna 109 and a cellular wireless modem 108. In one embodiment, initiating component 100 sends and receives messages using, for example, the Short Message Service (SMS). In other embodiments of the present invention, wireless communications component 107 may comprise a Bluetooth wireless communications device, or another wireless communications device such as a Wi-Fi transceiver. Wi-Fi transceivers are often used to create local area networks between a portable computer and an Internet access point in public areas such as airports, coffee shops, libraries, and the like.

Position determining component 110 is for determining the location of initiating component 100. In embodiments of the present invention, position determining component 110 comprises a GNSS antenna 112 and a GNSS receiver 111. However, while the present embodiment specifically recites a GNSS position determining system, embodiments of the present invention are well suited to utilize a variety of terrestrial-based and satellite-based position determining systems as well.

A control element 113 is coupled with bus 102 and is for generating a control signal via control interface 114 depending upon the current time and/or location of initiating component 100. It is noted that while control element 113 is shown as a separate element, in embodiments of the present invention, the control element functionality may be implemented by processor 101.

Devices which are optionally coupled to initiating component 100 include a display device 116 for displaying information to a user. Display device 116 may be a liquid crystal device, cathode ray tube, a field emission display, or other display device suitable for creating graphic images and alphanumeric characters recognizable to a user. A user input device 115 may also be coupled with bus 102 in embodiments of the present invention. In embodiments of the present invention, user input device 115 may comprise a keyboard, and a cursor control device (e.g., a mouse, trackball, light pen, touch pad, joystick, etc.), for inputting data, selections, updates, and for controlling initiating component 100. Initiating component 100 may optionally include a battery 117 for providing power for initiating component 100. While the present embodiment recites a battery powered device, the present invention is well suited to be electrically coupled with the device it is controlling and for drawing power from that device. For example, if initiating component 100 is disposed within a laptop computer, it may draw power from the laptop computer itself.

In embodiments of the present invention, components of initiating component 100 may be disposed upon a printed circuit board 120 such as a Personal Computer Memory Card Industry Association (PCMCIA) card, etc. This allows embodiments of the present invention to be used in a variety of electronic devices such as cellular telephones, laptop computers, PDAs, and the like. However, in other implementations of the present invention, initiating component 100 may be a stand alone device that is used to control another device. For example, initiating component 100 may be installed in an automobile and used to initiate an action depending upon the location of the automobile. Thus, the components comprising initiating component 100 may be disposed within a housing.

It is appreciated that some of the components recited in the above discussion may be omitted in embodiments of the present invention. For example, when initiating component 100 is disposed within a laptop computer, or a PDA, display device 116 and user input device 115 may be redundant and therefore omitted to reduce the cost of initiating component 100. In other implementations of the present invention, initiating component 100 may be disposed in an electronic device already having a wireless communications capability (e.g., a cellular telephone). Thus, wireless communications component 107 may be omitted in embodiments of the present invention in order to reduce the cost of initiating component 100. Additionally, control element 113 may be omitted in embodiments of the present invention. For example, a control signal may be generated by processor 101 via control interface 114 for controlling an electronic device.

In embodiments of the present invention, when motion detector 106 detects movement of initiating component 100, it generates an interrupt signal to processor 101. In response to the interrupt signal, processor 101 activates other components of initiating component 100 such as wireless communications component 107 and/or position determining component 110. The geographic location of initiating component 100 is then determined using position determining component 110. Processor 101 compares the present geographic location with geographic coordinates that define a pre-defined zone. The coordinates of the pre-defined zone may reside in RAM 104 or in storage device 105. Based upon this comparison, processor 101 causes control element 113 to generate a command for controlling the electronic device in which initiating component 100 resides.

Alternatively, processor 101 may generate the command for controlling the electronic device itself. For example, initiating component 100 may be configured to generate a command causing the electronic device to become deactivated when it enters a restricted zone such as a theater, or the gangway leading from the departure lounge to the aircraft while boarding. Since the unit is programmed to operate autonomously to perform this shutdown function, it will work for items which are stored in luggage as well, performing another valuable service by ceasing battery drain while located in an unusable space. When the electronic device moves outside of the restricted zone, processor 101 may generate a signal causing the electronic device to become activated again. This is a great convenience to users who may forget to turn off their electronic devices when they enter a restricted area or to turn them back on when they leave the restricted area.

It should be appreciated that a full forced power shutdown exemplifies one type of deactivation and that re-energizing after such a power down exemplifies one type of reactivation. Embodiments of the present invention are well suited to deactivate and/or reactivate the electronic device in other ways, e.g., short of a full power-down event and/or re-energizing thereafter. For instance, the device can be deactivated without a full power down, as where wireless transmissions from the device may be disabled while within a geo-temporally restricted zone, yet remain capable of performing another function. Similarly, in this instance, reactivating the device after such a deactivation could simply comprise restoring wireless transmission capability to the device upon leaving the geo-temporal zone wherein such transmissions are forbidden (e.g., to be secured, forced transmission squelched, etc.).

In embodiments of the present invention, storage device 105 stores a database of geographic coordinates which can define a plurality of pre-defined zones and associated commands that are to be generated by processor 101 depending upon whether the electronic device is inside of or outside of a pre-defined zone. Additionally, the geographic coordinates can define a route or plurality of routes. If the electronic device deviates from a specified route, processor 101 can generate commands to the electronic device. For example, processor 101 can cause the electronic device to sound an alarm or other noise, vibration, light emission, and/or production, emission, and/or presentation of any other human-detectable, human sensory sensitive, etc. stimulus, attention elicitor, irritant, or the like, for instance, as a theft deterrent if the device is removed from a specified zone. Alternatively, processor 101 can initiate sending a message via wireless communications component 107 notifying the owner of the electronic device that it has left a specified zone, or notify police or other agencies. Additionally, processor 101 can initiate continuous location updates to assist in recovering the electronic device if it has been stolen.

The geographic location or route information used to determine what action should be initiated by the present invention may further be modified using temporal information. For example, if initiating component 100 is disposed within an automobile, time parameters may be used in conjunction with location parameters to determine what action should be initiated by the present invention. Thus, users could designate their typical route used when commuting to work and the hours when the automobile is permitted to be within that route. If the automobile is stolen, even if it is at a geographic location within the pre-defined boundaries of the commuting route, initiating component 100 may generate a control signal because it is at that location at the wrong time of the day. Initiating component 100 may initiate generating a message conveying that the automobile has been stolen as described above, or may in some manner disable the automobile to prevent further movement of the automobile.

For example, initiating component 100 may be coupled with the ignition system or the computer of the automobile. After determining that unauthorized movement of the automobile has occurred, initiating component 100 may generate a control signal to disable the automobile's engine the next time motion detector 106 determines that the automobile has stopped moving. This is so that initiating component 100 does not disable the automobile, for example, in the middle of a highway which may endanger other commuters. An initiating device lacking the motion detector of the present invention would not be able to perform in this manner and may provide a less flexible or responsive solution to some situations addressed by the present invention.

Utilizing a motion detector with a position determining device is seemingly counter-intuitive or at least redundant in the current position reporting environment which relies upon successive position fixes to imply movement of the reporting device. For example, receiving a series of position reports which come from different locations implies that the initiating device is in motion. Alternatively, receiving a series of position reports which come from the same location implies that the initiating device is stationary. Therefore, it was considered redundant to incorporate a motion detecting component into a device which already had an implied function of detecting and reporting motion.

However, providing initiating component 100 with motion detector 106 is advantageous because it reduces the amount of time that components of initiating component 100 are activated in order to determine a geographic location and thus extends the battery life of the electronic device with which initiating component 100 is coupled. In prior art initiating devices, determining whether the device was moving or stationary depended upon determining and comparing successive position fixes. If successive position fixes were from the same location, it was inferred that the device was stationary. If successive position fixes were from different locations, it was inferred that the device was in motion.

These position fixes had to be provided at a regular interval in order to provide timely notification that the device was being moved. However, providing successive position fixes for a device which has not moved is an unnecessary drain of battery power, especially when the device remains stationary for extended periods of time. This in turn is burdensome to users of the device who are required to frequently replace the batteries of the electronic device in which initiating component 100 is disposed or to couple the electronic device to an external power source.

In embodiments of the present invention, storage device 105 or volatile memory 104, etc. may also store previously determined geographic positions of initiating component 100, other position information such as previously determined pseudoranges, and/or previously sampled GNSS signals as an aid to signal acquisition in environments where a clear path to the satellites is either partially or totally obscured, as inside a building. For example, in some GPS implementations, previously sampled GPS signals are used to more rapidly determine the current location of a GPS receiver and improve its sensitivity during low signal-to-noise ratio conditions. One such system is described in U.S. Pat. No. 6,289,041 titled Fast Acquisition, High Sensitivity GPS Receiver by Norman F. Krasner, assigned to SnapTrack Inc. of San Jose, Calif., and incorporated by reference herein in its entirety. In this patent, Krasner describes a system in which a currently sampled GPS signal is accumulated with a previously sampled GPS signal in order to improve the sensitivity and acquisition speed of the receiver. However, the present invention is well suited to utilize a variety of implementations for improving the sensitivity of a GPS receiver during low signal-to-noise ratio conditions.

While embodiments of the present invention can be utilized as a stand alone device, other embodiments of the present invention may utilize other methods for determining the location of an electronic device. For example, many cellular telephone systems are compliant with the E911 standards which seek to improve the quality of wireless 911 service. Phase 1 of the program requires carriers to report the location of the antenna receiving the wireless call. Phase 2 of the program requires carriers to provide much more exact location information (e.g., within 50-100 meters).

One solution for providing Phase 2 level compliance is a server aided location determining system as described in U.S. Pat. No. 6,131,067 titled Client-server Based Remote Locator Device by Richard Girerd and Norman Krasner, assigned to SnapTrack Inc. of San Jose, Calif., and which is incorporated by reference in its entirety herein. In this system, a remote device sends GPS data to a server which processes the data to derive the location of the remote device. The server then transmits the derived location to a client which can display the location of the remote device. In embodiments of Girerd, the remote device can send unprocessed position signals (e.g., GPS satellite signals) to the server which are then processed to derive the location of the remote device.

Further, as discussed in Section II below, position determining may be achieved in one embodiment using a technique with reference to television signals. In one embodiment, position determination can be achieved with a selection from multiple technologies. In one embodiment, position determination is achieved with a digital television-based positioning system, such as is described in U.S. Pat. Nos. 6,806,830, 6,753,812, 6,727,847, 6,717,547, 6,559,800, and 6,522,297, which are assigned to the Rosum Corporation of Mountain View, Calif., and which are incorporated herein by reference. This system substantially relies on position determination using multiple television transmitters.

Thus, embodiments of the present invention are well suited to enable an electronic device to determine its location and the time on a stand alone basis, or in conjunction with other so-called "aiding" systems. When the electronic device is outside of the coverage area of a wireless communications system, it can still determine its location and the time using embodiments of the present invention.

Exemplary Position Determining System

Figure 2:
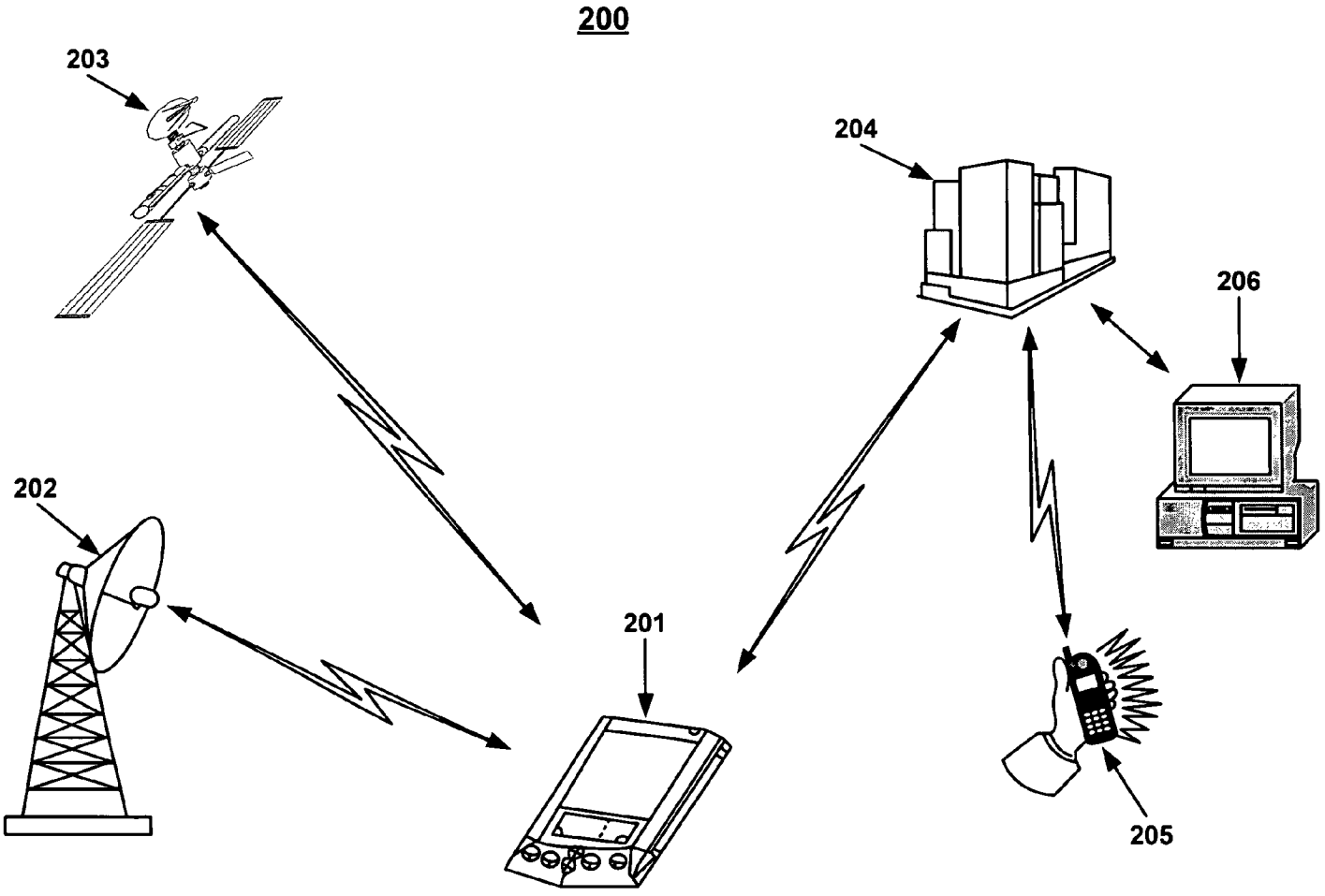
FIG. 2 depicts an exemplary position determining system, according to an embodiment of the present invention.

FIG. 2 depicts an exemplary position determining system 200, according to one embodiment of the present invention. System 200 comprises an electronic device 201 that is coupled with an initiating component 100 (FIG. 1), a position determining system (e.g., position determining system 202 or 203), and a position tracking service provider 204. In one embodiment, electronic device 201 comprises a portable device. In one embodiment, initiating component 100 is disposed within electronic device 201.

As depicted in FIG. 2, electronic device 201 is capable of wireless communications with service provider 204. When electronic device 201 is moved, initiating component 100 detects the movement and determines its geographic location using position determining system 202 and/or position determining system 203.

In accordance with embodiments of the present invention, position determining system 202 is a terrestrial-based position determining system. There are a variety of terrestrial-based position determining systems which can be utilized by embodiments of the present invention such as LORAN-C, Decca, radio beacons, television transmissions, etc. Furthermore, the present invention is well suited to utilize future implementations of terrestrial-based position determining systems.

In other embodiments of the present invention, initiating component 100 utilizes a satellite-based position determining system 203 to determine its position. There are a variety of satellite-based position determining systems which can be utilized by embodiments of the present invention such as GNSS, GPS, Differential GPS (DGPS), Eurofix DGPS, GLONASS, etc. Furthermore, the present invention is well suited to utilize future implementations of satellite-based position determining systems such as the Galileo™ system.

As described above, embodiments of the present invention can determine the location of electronic device 201 and then compare the present location of electronic device 201 with a set of geographic coordinates of a pre-defined zone. Depending upon the relationship between the present location of electronic device 201 and the pre-defined zone, initiating component 100 may generate a command causing electronic device 201 to perform an action. For example, if electronic device 201 is moved from a specified zone without permission, a wireless message may be sent to position tracking service provider 204 as notification. Alternatively, initiating component 100 may cause electronic device 201 to emit an audible alarm until a user enters a security code (e.g., using input device 115; FIG. 1).

In one embodiment, in response to control with initiating component 100, electronic device 201 emits a wireless query message to access information relating to the local time corresponding to the current geo-location of the device. Thus, in one exemplary implementation, device 201 wirelessly queries a provider of information relating to the local time corresponding to that location when it is inactive (e.g., asleep, powered down, etc.) during movement from one geo-location to another, such as during travel. Yet the device remains responsive to reaching the destination geo-location.

While the embodiment of FIG. 2 recites using initiating component 100 in conjunction with a position tracking service provider (e.g., position tracking service provider 204; FIG. 2), the present invention is well suited to being used as a stand alone device. That is, initiating component 100 may be used to control an electronic device without interacting with position tracking service provider 204. For example, a user may simply desire to cause electronic device 201 to perform specific actions depending upon the geographic zone it is in, but not to report to position tracking service provider 204.

Exemplary Operating States

Figure 3:
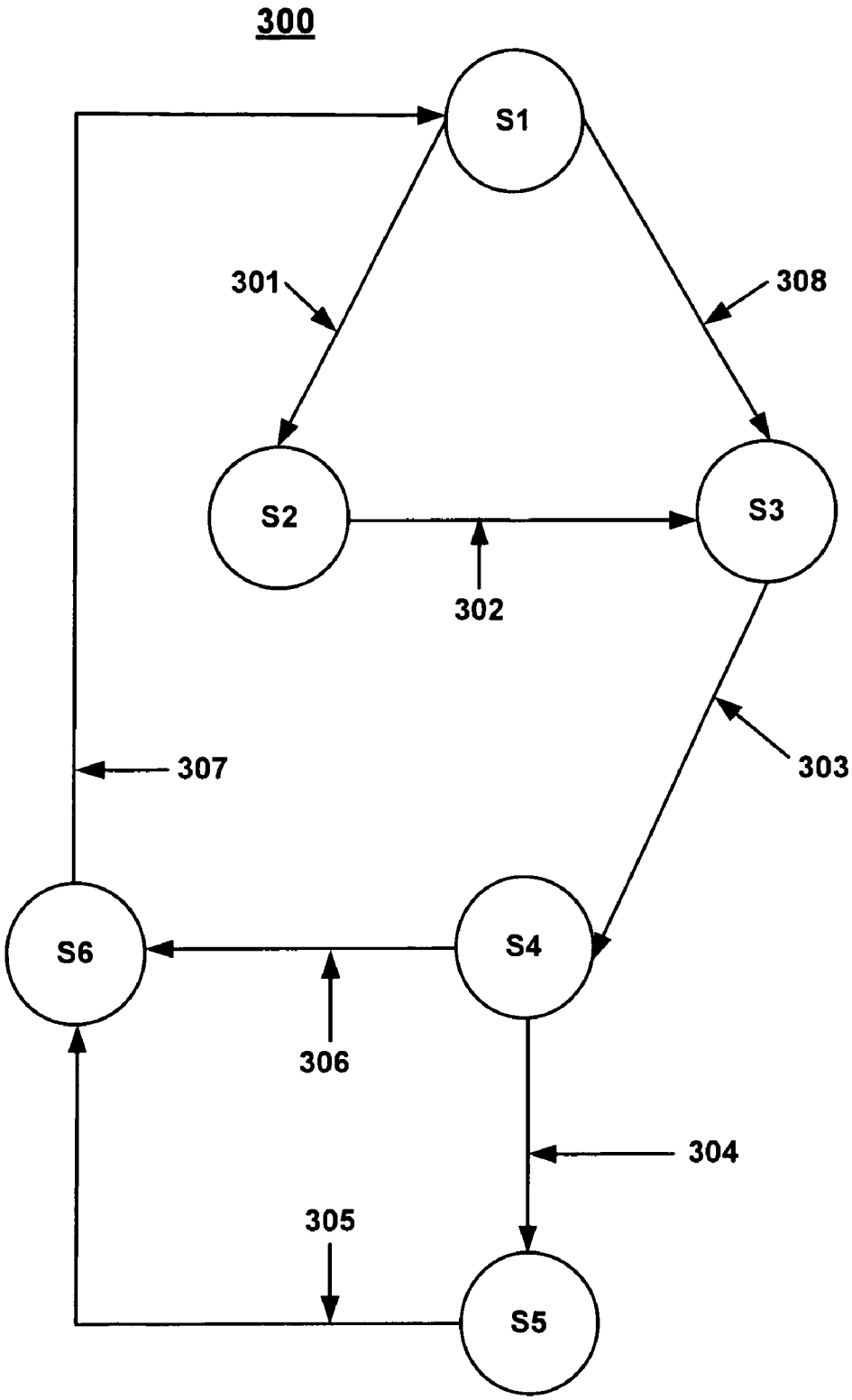
FIG. 3 depicts exemplary operating states of an initiating component utilized in accordance with an embodiment of the present invention.

FIG. 3 depicts exemplary operating states of an initiating component utilized in accordance with one embodiment of the present invention. For instance, the operating states depicted in FIG. 3 correspond, in one embodiment, to the operating states of initiating component 100 in accordance with embodiments of the present invention.

In operating state 51, initiating component 100 is in an idle operating state. In embodiments of the present invention, when initiating component 100 is in its idle state the only components drawing power are a real time clock of processor 101 and motion detector 106. This allows initiating component 100 to remain in an operating state in which a minimal amount of power is drawn from the electronic device (e.g., electronic device 201; FIG. 2) in which initiating component 100 is disposed. In embodiments of the present invention, as little as 10 μA are drawn while initiating component 100 is in idle operating state S1. Because battery drain is minimized in operating state S1, the battery replacement interval for electronic device 201 is thus extended. This is important for many portable electronic devices in which conserving battery life is a critical issue.

At event 301, motion detector 106 detects a change of the motion state of electronic device 201 and generates an interrupt to the controller of initiating component 100 (e.g., processor 101; FIG. 1). The change of motion state may be a starting or stopping of motion of initiating component 100. In response to the interrupt from motion detector 106, processor 101 causes initiating component 100 to transition to operating state S2. Operating state S2 is an active operating state of initiating component 100 in which initiating component 100 will attempt to attain a position fix of its current geographic location using position determining component 110.

When initiating component 100 successfully determines its position within a pre-determined time period, it automatically attempts to send a "fix" message to service provider 204 providing the current time and present geographic location of the device. Initiating component 100 will then continue to periodically determine its position and send that position information to service provider 204 while motion detector 106 detects that initiating component 100 is being moved. This allows service provider 204 to track initiating component 100, and thus the electronic device that initiating component 100 is monitoring, as it is being moved. The time period between position fixes is determined by the pre-determined time period of operating state S6 in embodiments of the present invention.

The pre-determined time period for determining the present location of initiating component 100 can be a default setting, set by the user of initiating component 100, or set by service provider 204 (e.g., via wireless communication with wireless communication component 107 of FIG. 1). If initiating component 100 cannot determine its position within the pre-determined time period, it will automatically initiate transmitting a "no-fix" message to position tracking service provider 204. The no-fix message conveys to service provider 204 that initiating component 100 has detected movement of electronic device 201 and that its position could not be determined using a position determining system (e.g., position determining system 202 or 203) within the pre-determined time period.

Time related information, e.g., a "time fix," relating to the operation of initiating component 100 can be accessed from the real time clock of processor 101, time related signals accessed with position determining component 110 and/or wireless communications component 107, etc., and/or with another input, such as from I/O 115.

In embodiments of the present invention, when initiating component 100 is in operating state S2, processor 101 and position determining component 110 are the only components drawing power. In embodiments of the present invention, current drain during operating state S2 is minimized while initiating component 100 is determining its location.

At event 302, initiating component 100 transitions to operating state S3. In accordance with embodiments of the present invention, initiating component 100 transitions to operating state S3 from operating state S2 after successfully determining its position. Alternatively, initiating component 100 automatically transitions to operating state S3 if a time period 308 expires before motion detector 106 detects movement. Time period 308 can be a default setting, a pre-determined parameter set by the user of initiating component 100, or set by service provider 204.

If initiating component 100 has successfully determined its location using position determining component 110, it then determines what action should be initiated based upon the current time and/or location in operating state S3. For example, a database may be accessed from storage device 105 that describes pre-determined actions to be taken based upon the current time and/or geographic location of initiating component 100. Thus, when electronic device 201 enters a zone defining an airport, the pre-determined action may be to generate a signal to invoke a shutdown routine for electronic device 201. When electronic device 201 leaves the zone defining the airport, initiating component 100 may generate a signal for starting electronic device 201 again.

Additionally, initiating component 100 may be configured to perform different actions depending upon what zone electronic device 201 is currently in. For example, if initiating component 100 is used to control a laptop computer, a user can configure the present invention so that a particular software application (e.g., a spreadsheet application) is initiated when the laptop is brought into the vicinity of the user's workplace and to initiate a different software application (e.g., a Web browser application) when the laptop is brought into the vicinity of the user's home.

As stated above, the action initiated by the present invention may also be determined by the current location in conjunction with the current time. Thus, the present invention may be configured to initiate one action when at a given location at a particular time and to initiate a second action at the same location but at a different time.

Returning now to FIG. 3, at operating state S3, processor 101 determines what action should be taken in response to the current time and/or current location of initiating component 100. Initiating component 100 then generates a command for controlling electronic device 201 based upon the current time and/or geographic location. Additionally, the real time clock of processor 101 may be updated using clock information obtained by position determining component 110 during operating state S2.

Additionally, during operating state S3, the operating parameters of initiating component 100 may be checked. For example, the status of battery 117 may be checked to determine if a battery change will be necessary soon. Other parameters may include the length of time period 308, the time interval for successfully determining the present geographic location of initiating component 100 (e.g., during operating state S2), the current software version of initiating device 100, and/or the current version of the database of pre-designated geographic zones, etc.

At event 303, initiating component 100 transitions to operating state S4. In operating state S4, initiating component 100 attempts to transmit data to position tracking service provider 204. For example, initiating component 100 may attempt to transmit the current time and geographic location of electronic device 201 to position tracking service provider 204 using wireless communications component 107. Additional information that may be sent includes the type of change in the motion state of initiating component 100. For example, the message may indicate that movement of initiating component 100 has been initiated, or stopped. Alternatively, if a pre-determined time period expires before initiating component 100 successfully determines its position (e.g., during operating state S2), initiating component 100 will transmit a message to service provider 204 conveying that electronic device 201 has been moved but was not able to determine its position using position determining component 110.

Additionally, the fix and no-fix messages may contain additional information such as the battery condition and current operating parameters of electronic device 201. By sending the battery condition information, the present invention reduces the amount of maintenance a user needs to perform to keep electronic device 201 operating properly. For example, position tracking service provider 204 can send a message to the user reminding him to change the batteries in electronic device 201 when it has determined that the batteries are low. In one embodiment of the present invention, a text message can be sent to the user's cell phone 205, or an E-mail message can be sent to the user's home or office computer 206 reminding him to change the batteries in electronic device 201. Additionally, position tracking service provider 204 may determine whether an update of the database of pre-designated geographic zones should be sent to initiating component 100.

In embodiments of the present invention, when service provider 204 receives the position fix message from initiating component 100, it compares the data in the message with a set of pre-defined position or geo-temporal parameters set by the user of electronic device 201. If the position of electronic device 201 is outside of the pre-defined position or geo-temporal parameters, a message can be sent to the user and/or law enforcement agencies telling them that electronic device 201 has been moved outside of the authorized position parameters. Additionally, service provider 204 can provide the position of electronic device 201 to, for example law enforcement agencies, to assist in recovering the device. Additionally, service provider 204 can change the operating parameters of initiating component 100 during operating state S4 so that position fixes are sent more often in order to assist in recovering the asset which is being monitored. Service provider 204 may also send a command to electronic device 201 causing it to perform a given action. For example, service provider 204 can send a command to electronic device 201 causing it to become deactivated until it is recovered or until a security code is entered. Service provider 204 can also send a command to electronic device 201 causing it to sound an alarm until it is recovered or until a security code is entered.

As an example, when a user first subscribes to the position tracking services of service provider 204 he will be asked if he wants to utilize geo-fencing. The user will provide the geographic coordinates of pre-defined zones for electronic device 201 that specify an area or areas in which electronic device 201 is permitted to move without initiating a warning message to the user and the time periods which electronic device 201 is permitted to be in those areas. The user can also specify an action that is to be initiated by processor 101 if electronic device 201 enters or leaves one of the pre-defined zones. If, for example, electronic device 201 is moved outside of this position or area, service provider 204 contacts the user and/or law enforcement agencies and informs them that unauthorized movement of electronic device 201 has occurred. Service provider 204 may send a text message to the user's cellular telephone 205, an E-mail to the user's computer 206, etc. As described above, service provider 204 may send commands which change the operating parameters of initiating component 100 to cause it to send more frequent position reports when unauthorized movement of the asset is detected to assist in recovering electronic device 201.

At event 304, initiating component 100 transitions to operating state S5. While in operating state S5, initiating component 100 is in a query state and can receive commands and operating parameters from service provider 204. Additionally, at this time commands can be received for changing the operating parameters of initiating component 100. For example, the time period in which position determining component 110 is allowed to determine the position of initiating component 100 can be changed during operating state S5. Other parameters may include the database defining pre-designated geographic zones for initiating action and/or the action to be taken when entering or leaving one of the pre-designated geographic zones. While the present embodiment recites these parameters specifically, the present invention is well suited for receiving commands for a variety of actions while in operating state S5. In one embodiment, while initiating component 100 is in operating state S5, only wireless communications component 107 draws power. Again, this reduces the amount of power drawn from electronic device 201 and extends the battery life of the device. In embodiments of the present invention, initiating component 100 functions to draw minimal power while in operating state S5.

At event 305, when communications with position tracking service provider 204 have completed, initiating component 100 transitions to operating state S6. Alternatively, at event 306, initiating component 100 transitions to operating state S6 if a pre-designated time interval elapses in which initiating component 100 was unable to successfully transmit data during operating state S4.

Operating state S6 is a delay state in which initiating component 100 is forced to remain idle for a pre-determined time period. This sets a time interval between successive position fixes and prevents initiating component 100 from drawing excessive battery power from electronic device 201 in attempting to constantly determine its position while it is being moved. In embodiments of the present invention, initiating component 100 draws as little as 10 μA of power while in operating state S5. The pre-determined time period is an operating parameter which can be a default setting, set by the user of initiating component 100, or by service provider 204 during operating state S5.

The length of the pre-determined time period of operating state S6 can be changed during the query operating state (e.g., operating state S5) as a result of receiving operating parameters from service provider 204. In one embodiment, if service provider 204 determines that unauthorized movement of initiating component 100 is occurring, the length of the time period of operating state S6 can be changed during operating state S5 to cause initiating component 100 to continuously or more frequently send its position to service provider 204. This facilitates locating and recovering the device in which initiating component 100 is disposed. After the pre-determined time period of operating state S6 has expired, initiating component 100 again enters operating state S1 at event 307 at which point initiating component 100 can repeat the process if motion detector 106 detects that electronic device 201 is being moved.

Figure 4:
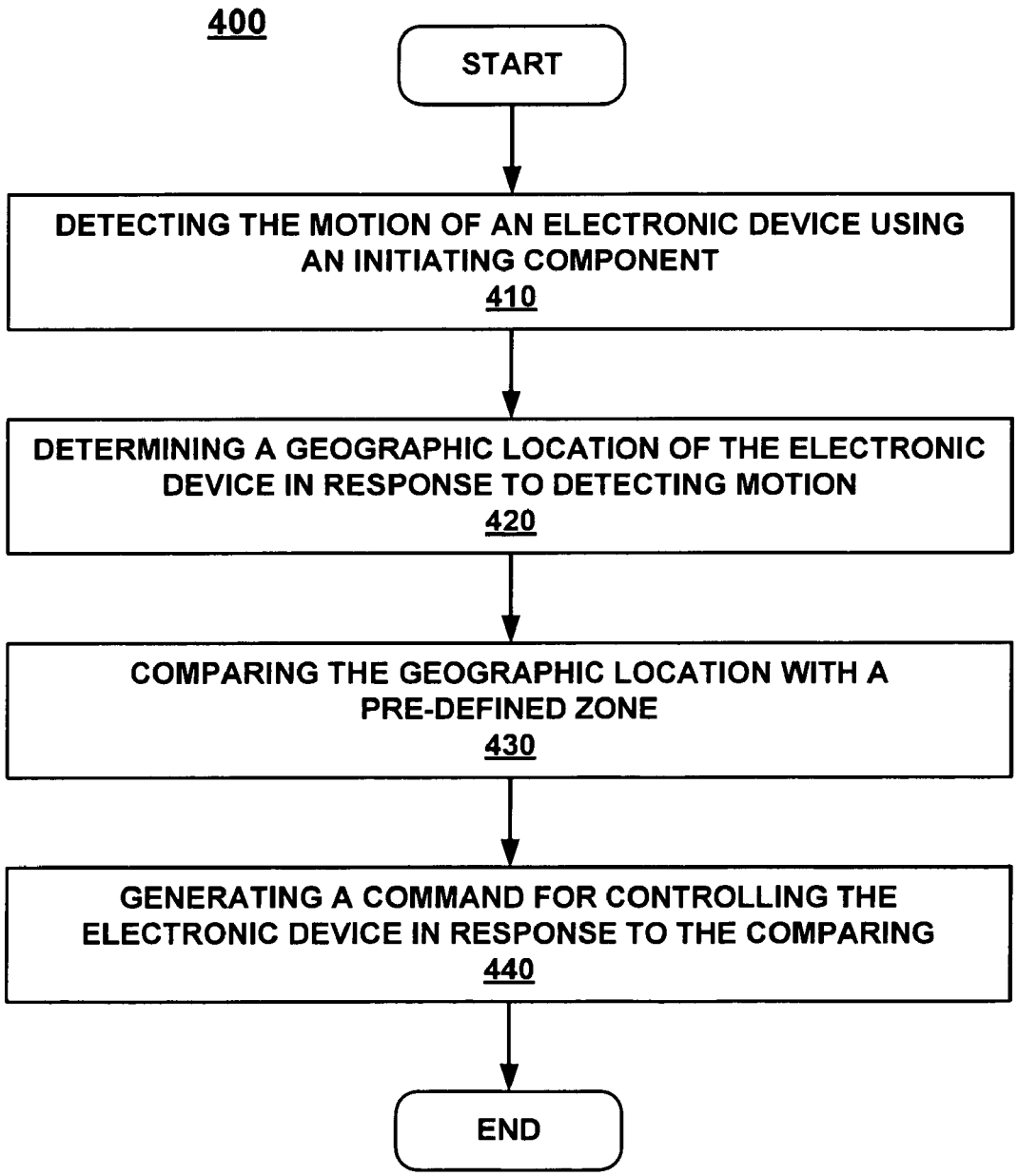
FIG. 4 is a flowchart of an exemplary method for controlling a device an embodiment of the present invention.

FIG. 4 is a flowchart of a method for reducing power consumption in a portable position reporting device in accordance with embodiments of the present invention. In step 410, the motion of an electronic device (e.g., electronic device 201; FIG. 2) is detected using an initiating component (e.g., initiating component 100; FIG. 1) that is disposed within the electronic device. According to embodiments of the present invention, a motion detecting component (e.g., motion detector 106; FIG. 1) is coupled with a controller (e.g., processor 101; FIG. 1). Motion detector 106 is for detecting changes in the state of motion of initiating component 100. For example, motion detector 106 can detect when initiating component 100 transitions from an idle state to a substantially moving state and/or changes in the rate of movement of initiating component 100. Thus, in embodiments of the present invention, motion detector 106 detects changes in the state of motion of initiating component 100 such as starting or stopping of motion, as well as acceleration/deceleration.

Coupling a motion detecting component which detects motion with initiating component 100 is a novel method of reducing power consumption for electronic device 201 because it allows initiating component 100 to monitor the location of electronic device 201 while drawing a minimal amount of power when movement has not occurred. In embodiments of the present invention, while initiating component 100 is in an idle operating state, only a real time clock of controller 101 and motion detector 106 are drawing power. Initiating component 100 does not attempt to determine its geographic location unless motion detector 106 detects a change in the motion state of electronic device 201. Thus, the number of position fixes to monitor the location of electronic device 201 are minimized and power consumption is reduced.

In step 420, the geographic location of the electronic device is determined in response to detecting its motion. In one embodiment, motion detector 106 detects movement of the electronic device in which initiating component 100 is disposed and indicates this movement to processor 101 when changes in motion are detected. In embodiments of the present invention, processor 101 automatically causes a position determining component (e.g., position determining component 110; FIG. 1) to determine the geographic location of electronic device 201 in response to receiving an interrupt from motion detector 106. In embodiments of the present invention, a terrestrial based or satellite based position determining system may be utilized to determine the geographic location of electronic device 201. Additionally, the processing of data to determine the geographic location of electronic device 201 may be performed by processor 101 or in conjunction with a remotely located server (e.g., service provider 204; FIG. 2).

In step 430, the geographic location determined in step 420 is compared with a pre-defined zone. In embodiments of the present invention, the present location of electronic device 201 is compared with geographic coordinates that define a zone. These coordinates can be stored in a memory (e.g., storage device 105; FIG. 1) coupled with processor 101 or stored remotely (e.g., at service provider 204; FIG. 2).

In step 440, a command for controlling the electronic device is generated in response to the comparing. In embodiments of the present invention, depending upon the relationship between the current geographic location of electronic device 201 (e.g., as determined in step 420 above) and the geographic coordinates that define a particular zone, a command is generated (e.g., with processor 101; FIG. 1) for controlling electronic device 201. Additionally, different commands can be generated depending upon the relationship between the current location of the electronic device and a particular pre-defined zone. For example, when electronic device 201 is within a given pre-defined zone, a first command is generated for controlling electronic device 201. When electronic device 201 is moved outside of that pre-defined zone, a different command for controlling electronic device 201 is used.

Exemplary State Machine

In one embodiment, initiating component 100 functions (e.g., is operated as, etc.) a state machine, which is persistent over power cycles, such as those discussed above with reference to FIG. 3, for example. Such persistence allows initiating component 100, upon "waking" from a programmed sleep period, for instance, to know (e.g., be aware of, etc.) its current state, and thus take a step (e.g., action, etc.) appropriate for performance upon such waking, etc.

Figure 5:
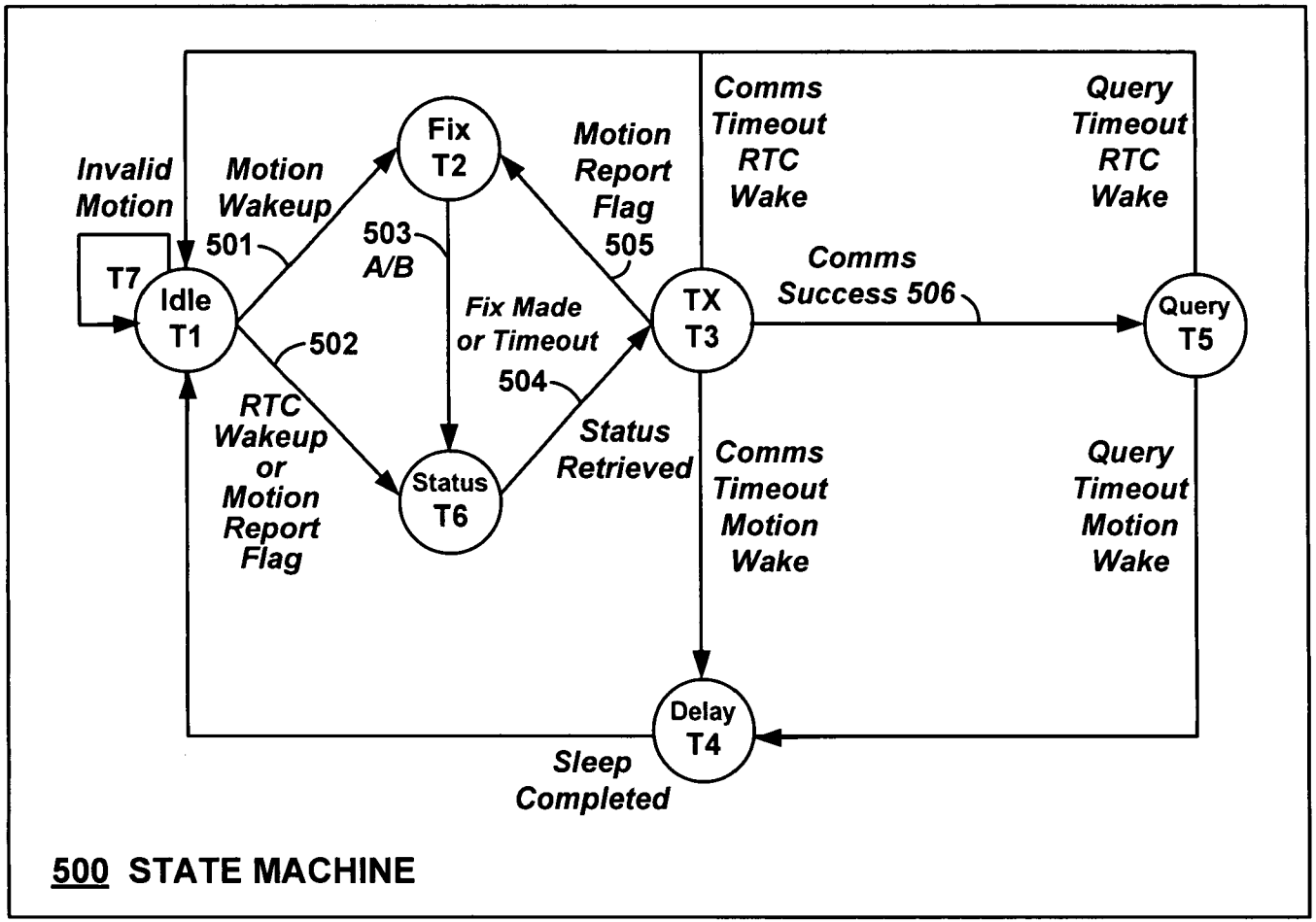
FIG. 5 depicts an exemplary state machine, according to an embodiment of the present invention.

FIG. 5 depicts an exemplary state machine 500, according to an embodiment of the present invention. Initiating component 100 implements state machine 500 with mechanisms similar to those discussed above with reference to FIG. 3. State machine 500 can typically spend most of its time in an 'idle' state T1.

Detection of motion, e.g., with motion detector 106, initiates a filtering algorithm which determines whether the motion is valid or not. Valid motion is motion that persists for more than a preset period, and can be inferred to correspond to purposeful motion towards a destination or along a route, etc. If the motion does not qualify as valid motion (e.g., invalid motion T7), state machine 500 resumes idle mode T1.

Upon determining that valid motion has been detected, initiating component 100 determines whether a motion report flag (not shown) is set to true. In embodiments of the present invention, the motion report flag may be a pre-set, or adjustable parameter which may be stored in ROM 103 or RAM 104. In embodiments of the present invention, when the motion report flag is false, state machine 500 makes a 'motion wakeup' transition 501 to a 'fix' state T2. When the motion report flag is true, state machine 500 makes a 'motion report' transition 502 to a 'status' state T6. State machine 500 can also transition to status state T6 upon a time related event such as a wakeup after a predetermined period corresponding to idle state T1, as determined for instance by a real time clock corresponding to time sensitive element 199.

During fix state T2, initiating component 100 functions, for a pre-determinable period of time, to fix its position and in one embodiment to ascertain (e.g., update) the current time. Where a fix, e.g., geographic/temporal, is achieved, state machine 500 makes a 'new fix available' transition 503A to status state T6. Where no fix is achieved within the time period allotted, state machine 500 makes a 'no new fix' transition 503B to status state T6.

During status state T6, initiating component 100 retrieves and stores the latest status information, including the new fix, if one is available. Upon retrieval, state machine 500 makes a 'status message' and transition 504 to a transmit state T3. Status information included in such a status report can include battery condition, battery change events, etc. In one embodiment, battery management functions, such as battery change events and battery voltage readings, are handled in the status state T6.

In transmit state T3, initiating component 100 functions to attempt to transmit associated position and status information, e.g., to a server such as service provider 204 (FIG. 2). In one embodiment, the latest status information is combined with position information, e.g., with a new application protocol message. Where motion report flag was true, state machine makes a corresponding motion report message transition 505 back to fix state T2.

Where the message is not a motion report message, state machine 500 does not immediately transition to fix state T2. Instead, where transmission is successful, state machine 500 makes a communications successful message transition 506 to 'query' state T5. Where the transmission is unsuccessful for a pre-determinable (e.g., programmable) period of time, state machine 500 transitions to delay state T4 or, where the wakeup type corresponds to a real time clock wakeup, to idle state T1.

In the query state T5, initiating component 100 waits to receive a request from the server for a pre-determinable time period. Where requests are received, they are processed in order, with responses sent if requested. After the time period expires, state machine 500 transitions to delay state T4 or, where the wakeup type corresponds to a real time clock wakeup, to idle state T1.

In the delay state T4, initiating component 100 disables wakeups generated by motion detector 106 and sleeps for a programmed period. After the programmed sleep time expires, initiating component 100 transitions to idle state T1. In so doing, motion detector 106 is re-enabled. Initiating component 100 then goes back to sleep.

Exemplary Time & Position Based Control

Initiating component 100 allows control of an electronic device (e.g., in which it is disposed) based on its location relative to a geographic zone, as described above. In one embodiment, initiating component 100 further allows control of the electronic device based on the device being within a geo-temporal zone, which is defined on the basis of geographic location or a combination of geography and time.

In one such embodiment, time sensitive element 199 and processor 101 function with position determining component 110 and/or wireless communications component 107 to allow initiating component 100 to control a device to perform a particular task upon entering or leaving the geo-temporal zone. For instance, in the present embodiment, initiating component 100 allows the device to enable (e.g., to become enabled) within a pre-selectable (e.g., programmable) window of time and/or disables the device within such a window.

Exemplary Processes

Figure 6:
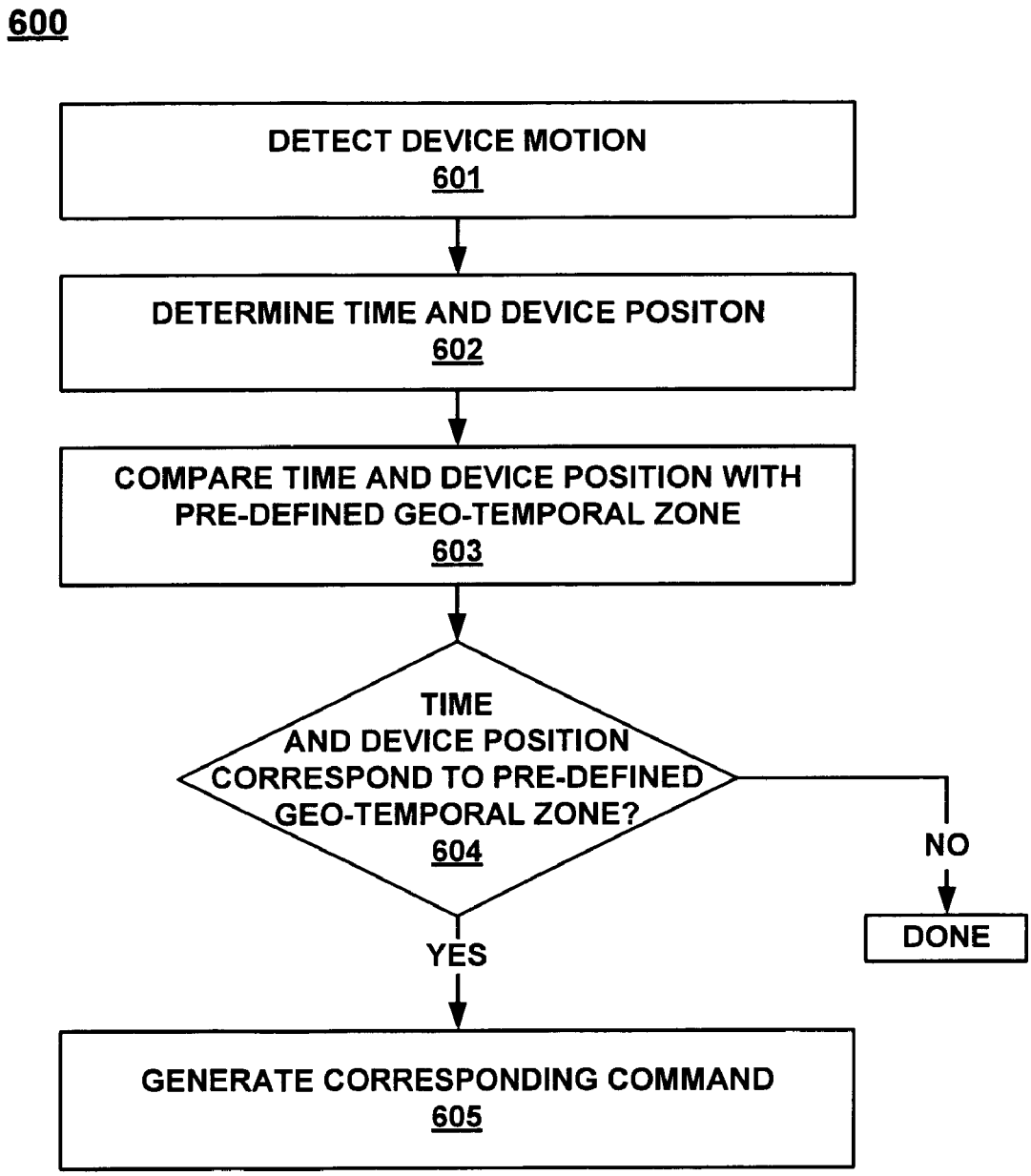
FIG. 6 is a flowchart of an exemplary method for controlling an electronic device, according to embodiments of the present invention.

FIG. 6 is a flowchart of an exemplary process 600 for controlling an electronic device, according to an embodiment of the present invention. Process 600 begins with step 601, wherein device motion is detected.

In step 602, the time corresponding to the motion detection and the present geographic location of the device is determined. In step 603, the time and device position is compared with a pre-defined geo-temporal zone. In step 604, it is determined whether the time and device position corresponds to the pre-defined geo-temporal space. If not, process 600 can be completed.

Where it is determined that the time and device position corresponds to the pre-defined geo-temporal space, in step 605, a control command is generated for the device, which corresponds to the presence of the device within the geo-temporal zone, completing process 600.

Figure 7:
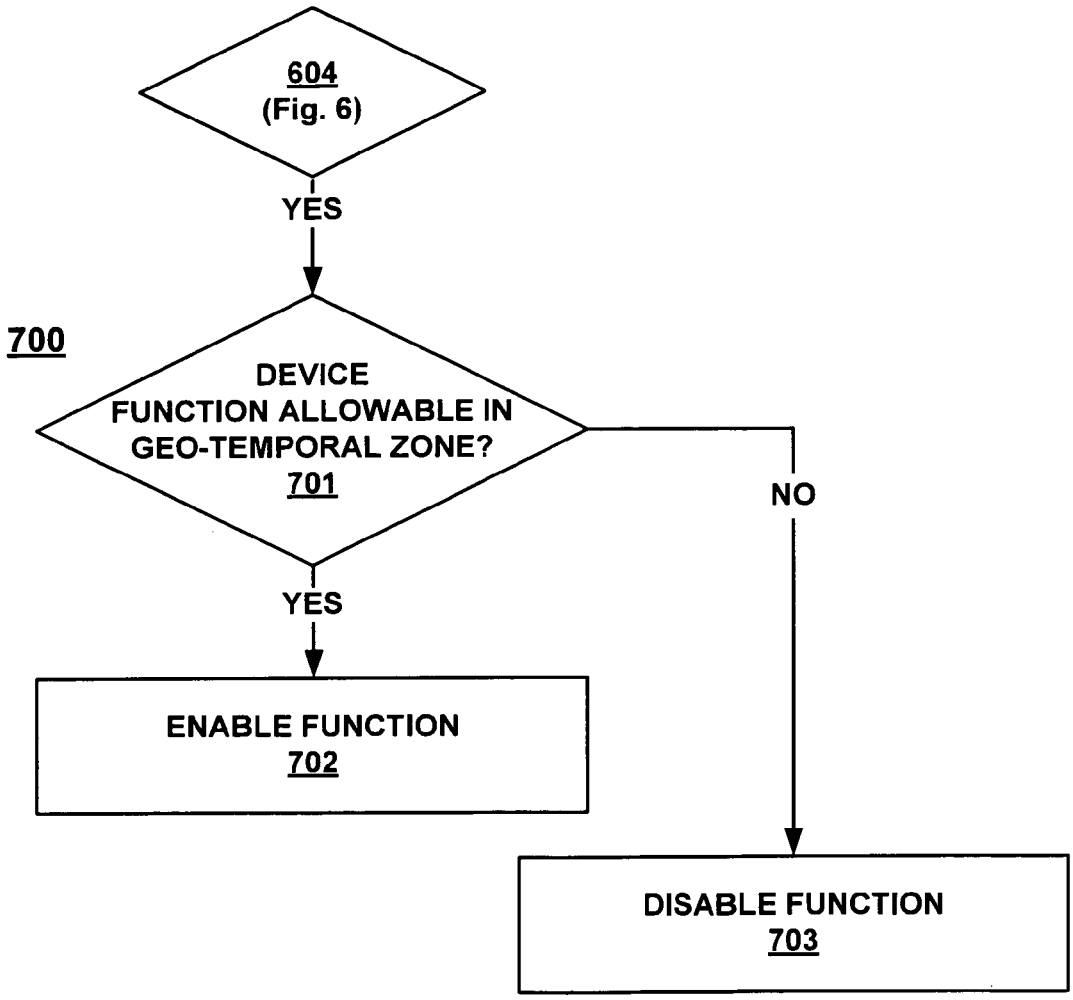
FIG. 7 is a flowchart of another exemplary method for controlling an electronic device, according to embodiments of the present invention.

FIG. 7 is a flowchart of an exemplary process 700, e.g., corresponding to step 605 (FIG. 6), for generating an appropriate control command for an electronic device, according to an embodiment of the present invention. Process 700 begins with step 701 wherein, upon determining that the time and device position corresponds to the pre-defined geo-temporal space (e.g., step 604; FIG. 6), it is determined whether a function of the device is appropriate for (e.g., allowable in) the geo-temporal zone. If so, in step 702, the device function is enabled. If not, in step 703, the device function is disabled.

Figure 8:
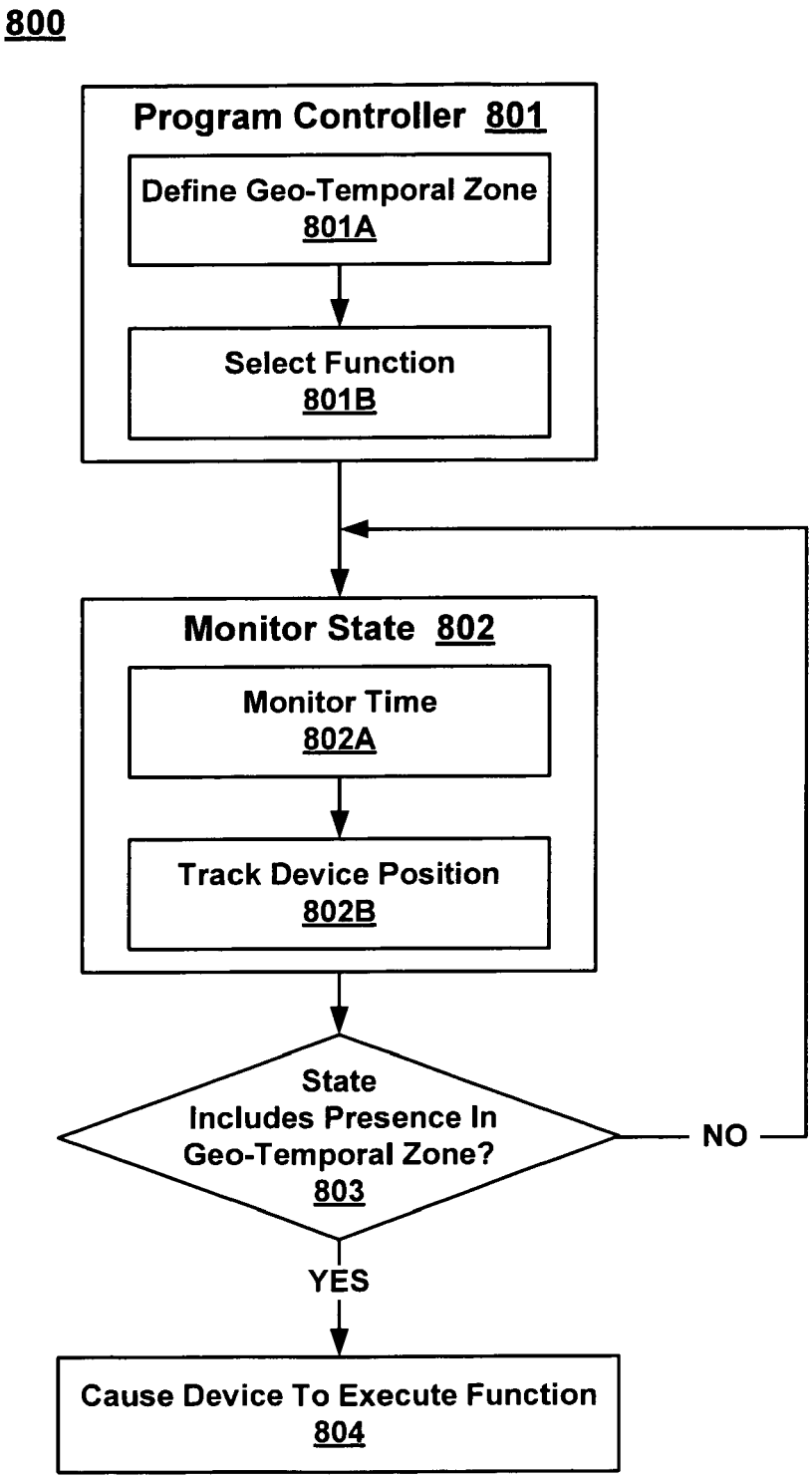
FIG. 8 is a flowchart of yet another exemplary process for controlling an electronic device, according to an embodiment of the present invention.

FIG. 8 is a flowchart of an exemplary process 800 for controlling an electronic device, according to an embodiment of the present invention. Process 800 begins with step 801, wherein the controller of a portable electronic device is programmed.

In one embodiment, step 801 comprises steps 801A and 801B. In step 801A, a geo-temporal zone, corresponding to a certain real time and a particular geographic location, position, boundary, etc., is defined. In step 801B, a function correspondingly appropriate for the defined geo-temporal zone is selected.

In step 802, a state corresponding to the device is monitored. In one embodiment, step 802 comprises steps 802A and 802B. In step 802A, real time is monitored by the controller, the device, etc. In step 802B, the position (e.g., geographic, location-based, etc.) of the device is monitored, such as with tracking.

In step 803, it is determined whether the device state includes the presence of the device within the defined geo-temporal zone. If not, process 800 loops back to step 802 and continues monitoring the state of the device. Where it is determined that the device state includes the device being present within the defined geo-temporal zone, then in step 804, action is taken to cause the device to execute the selected function (e.g., the function selected in step 801B), completing process 800.

Section II

Improved Position Determination System and Method of the Present Invention

Embodiments of the present invention relate to systems and methods for improving the position determination of an electronic device. Systems and methods of the present invention can be implemented in a variety of different geopositioning, geo-temporal control, network and/or computer systems such as some for geopositioning determination based on, for example, GNSS and other geo-temporal zone based control systems as described above. Exemplary embodiments of the present invention effectively integrate geopositioning system based on GNSS, or similar technologies, with a geopositioning sub-system based on, for example, signals received from television (TV) broadcast transmitters, etc. The description herein in Section I above describes exemplary geopositioning, geo-temporal control, network and/or computer systems for geopositioning determination, and thus represents a discussion of an exemplary platform upon which embodiments of the present invention can be practiced, e.g., systems and methods for improving the position determination of an electronic device according to an embodiment of the present invention.

Exemplary Positioning System

Figure 9:
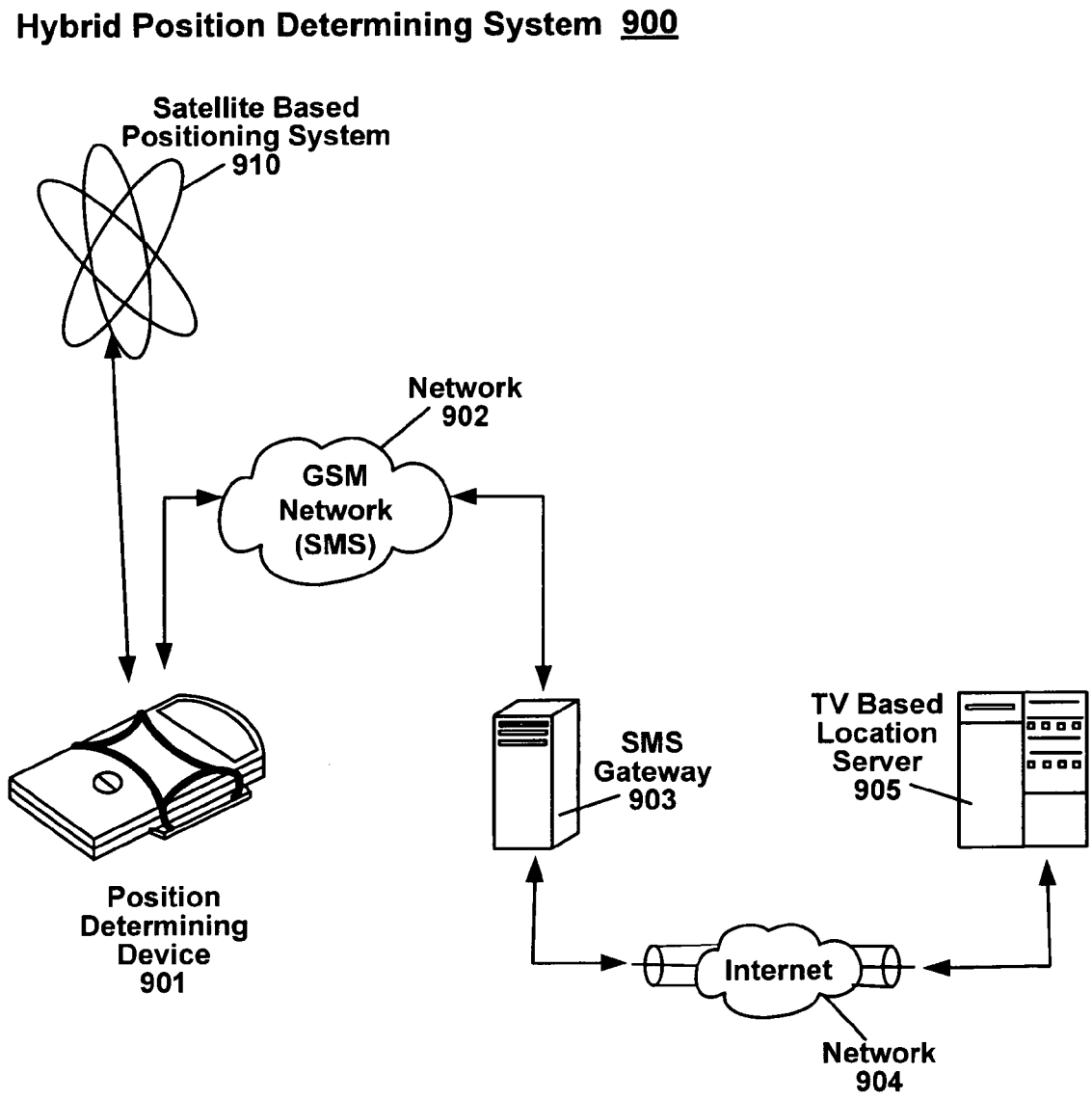
FIG. 9 depicts an exemplary position determining system, according to an embodiment of the present invention.
Figure 10:
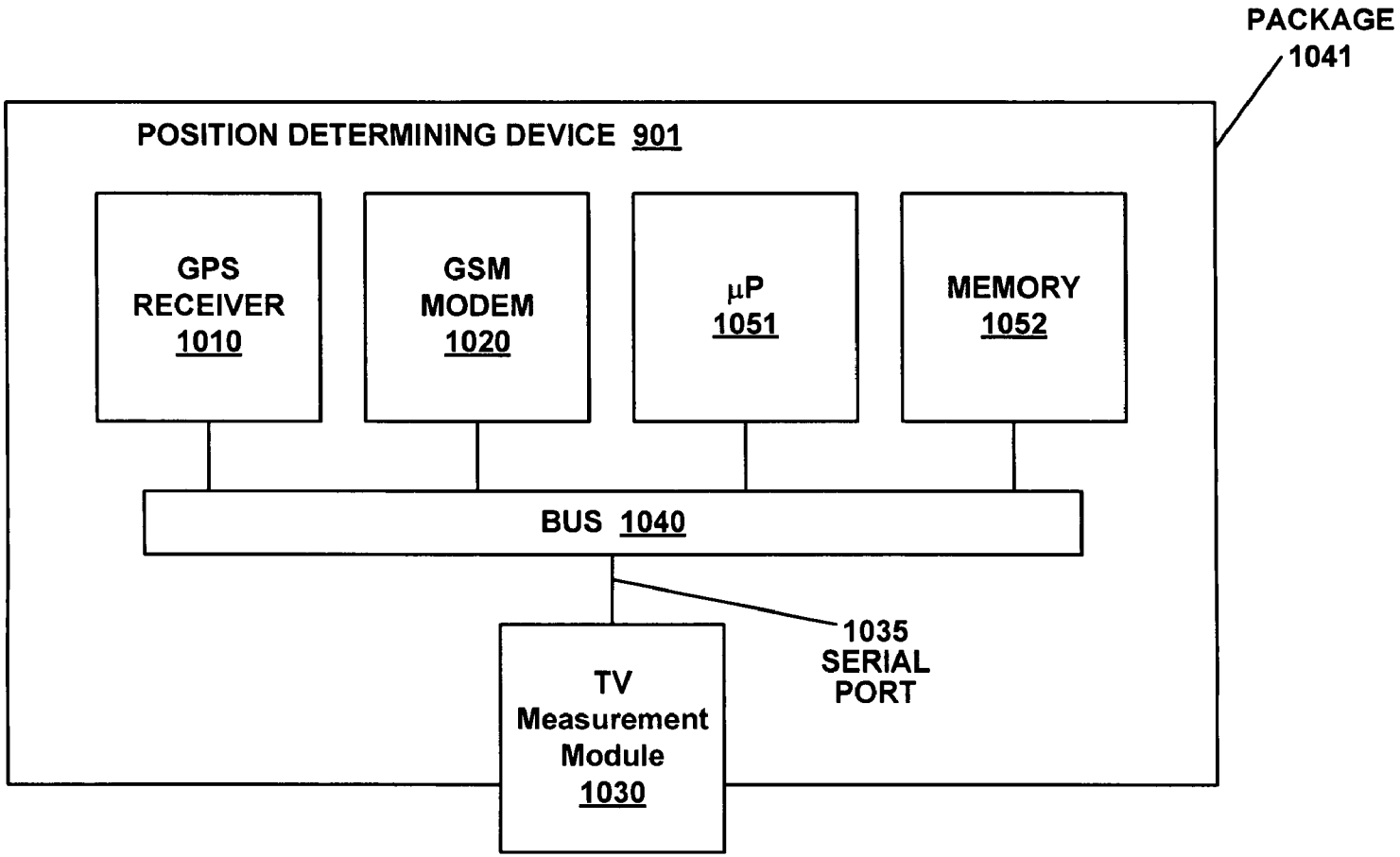
FIG. 10 depicts an exemplary position determining device, according to an embodiment of the present invention.

FIG. 9 depicts an exemplary positioning system 900, according to an embodiment of the present invention. Positioning system 900 includes a position determining device 901. Position determining device 901 comprises, in one embodiment, a small, lightweight, highly portable, battery-powerable device capable of detecting motion (e.g., movement), determining geographic and/or related position, determining time and geo-temporal position and status, determining and changing operational state, and wirelessly communicating information related to such movement, position, status and state to a remote server or another network coupled entity, for instance as described above in Section I. For instance, device 901 includes, in one embodiment, a motion detector such as motion detector 106 (FIG. 1) and its processor (microprocessor 1051; FIG. 10) performs real time clock (RTC) functionality.

In contrast to some devices, which may also operate as described above in Section I and which achieve their optimal performance in relation to position determining accuracy in open, outdoor environments, position determining device 901 achieves accurate position determining accuracy in other environments, as well. Thus, while it accurately determines position in open, outdoor environments, position determining device 901 also accurately determines position in environments that can constrain or restrict the position determining accuracy of other devices such as for instance, both indoor and in so-called urban canyon environments, e.g., densely developed urban areas. Position determining device 901 is thus usefully functional in the open outdoors, inside buildings, and in densely developed urban areas.

In one embodiment, position determining device 901 functions with position determining technologies including GNSS based and/or similar position determining techniques and a position determining technique achieved with access to television signals from at least one television transmitting tower. While the present embodiment is described with reference to GNSS as comprising the geo-location determining system, it should be appreciated that an alternative embodiment may be practiced where the geo-location determining system comprises a system other than GNSS. In such an embodiment, the geo-locating functionality is capable of accessing that system. In one embodiment, the geo-locating functionality comprises a GPS functionality capable of accessing one or more geo-location systems, in addition to its GPS access capability.

Further, position determining is achieved in one embodiment using a technique with reference to at least one television signal. In one embodiment, position determination is achieved with a digital and/or analog television based, and/or radio or other broadcast based positioning systems and techniques. Such systems and techniques are described in U.S. Pat. Nos. 6,861,984, 6,753,812, 6,727,847, 6,717,547, 6,559,800, and 6,522,297 (hereinafter the Rosum patents), which are assigned to the Rosum Corporation of Mountain View, Calif. The aforementioned U.S. Patents are hereby incorporated by reference herein. These systems and techniques substantially rely on triangulation position determination using multiple television broadcast transmitters.

Thus, embodiments of the present invention are well suited to enable a position determining device 901 to determine its location on a stand alone basis, or in conjunction with other so-called "aiding" systems. Thus, whether position determining device 901 is in the open outdoors, inside a building, in an urban canyon environment, or outside of the coverage area of a wireless communications system, it can still determine its location and the time using embodiments of the present invention.

Exemplary Position Determination System

FIG. 10 depicts exemplary position determining device 901, according to an embodiment of the present invention, in somewhat greater detail. FIGS. 9 and 10 are discussed together. In the context of the present embodiment, position determining device 901 includes three components, which are functionally intercoupled for instance with a bus 1040. It should be appreciated that bus 1040 couples these components, functional in the context of the present embodiment, as well as for instance, processor 1051, which performs a RTC functionality, memory 1052, power, and other components such as are described in Section I, above, including for instance motion detector 106 (FIG. 1). For clarity and brevity and so as not to unnecessarily obscure, occlude and/or obfuscate details especially significant in the context of the present embodiment, further discussion of such other components discussed above is omitted in Section II. For such details, reference is made to Section I above.

In the present embodiment, position determining device 901 includes a GPS (and/or e.g., another geo-position determining) receiver 1010, coupled with bus 1040 to a modulator/demodulator (modem) 1020. GPS receiver 1010 receives and processes position information such as pseudo ranges from satellite based GPS system 910. Modem 1020 in one embodiment is functional for modulating and demodulating signals exchanged between position determining device 901 and a network that includes and/or functions as a mobile communication system. In one embodiment, the mobile communication system network with which device 901 exchanges signals has attributes that are compatible with those of (e.g., and thus substantially compliant with standards and specifications relating to) the Global System for Mobile Communications (GSM). In the present embodiment, this GSM network enables Short Message Service (SMS) communications, and thus supports domestic and international roaming and other features.

In the present embodiment, position determining device 901 also includes a measurement module 1030, with which GPS receiver 1010 and GSM modem 1020 are functionally intercoupled via bus 1040. Embodiments of the present invention allow the measurement module to be integrated within a package 1041 comprising device 901 or to be detachably intercouplable with such a package, for instance as an external daughter board, chip, stick or in another configuration. Where measurement module 1030 is detachably intercouplable from package 1041, measurement module 1030 communicates with the other modules (and/or e.g., with bus 1040) via a serial port 1035, for instance using a binary communication protocol such as the Rosum Serial Interface Protocol™ (RSIP™). It is noted that in embodiments of the present invention, measurement module 1030 may be wirelessly coupled with device 901 using, for example, a Bluetooth wireless interface. Embodiments wherein device 901 is implemented wherein the measurement module 1030 is so decouplable can have benefits related to portability, weight, form factor, power consumption and other aspects. Device 901 remains at least partially functional even with measurement module 1030 decoupled therefrom. For instance, device 901 would remain functional in one or more ways described above in Section I if measurement module 1030 is decoupled from serial port 1035.

In one embodiment, measurement module 1030 houses circuitry and related components and other hardware to power device 901 from an external power source. Portable external power sources, such as automotive, marine or other batteries, battery chargers and photovoltaic power supplies can thus be beneficial for energizing device 901.

In the present embodiment, measurement module 1030 performs measurements such as with signal processing and related triangulation calculations. In one embodiment, measurement module 1030 performs such measurements using signals received from multiple television transmitters, using the positioning technology described in the Rosum patents, incorporated herein by reference above, and further referred to herein as Rosum Positioning Technology™ (RPT™). Measurement module 1030 includes circuitry and related components and other hardware for acquiring television broadcast or other signals and to calculate with these signals pseudo-ranges for calculations and other processing with which the geographic position of device 901 may be determined.

With reference to FIG. 9, information is exchanged between device 901 and a TV-based location server 905. GSM modem 1020 allows device 1020 to communicatively couple, e.g., using SMS, via GSM network 902 to SMS gateway 903. SMS gateway 903 then communicatively couples device 901 via the Internet, or other network, 904 to TV based location server 905. As explained in the Rosum patents referenced above, a complex of associated monitor stations collect position determining information, referred to in some contexts as "aiding information," which is provided to location server 905. Using this information, location server 905 provides relevant position information to device 901 in one embodiment via SMS messaging. In one embodiment, the location based information is transferred to SMS gateway 903 via network 904. Network 904 in one embodiment comprises the Internet. The location information is provided to device 901 via network 902. In one embodiment, network 902 comprises a GSM capable network. Device 901 has a processor 1051 or a similar controlling component, which takes action to control the functional, operational state of device 901 based on positioning information received from the GPS system 910 or TV based location server 905.

Exemplary Location Determination Platform

Figure 11:
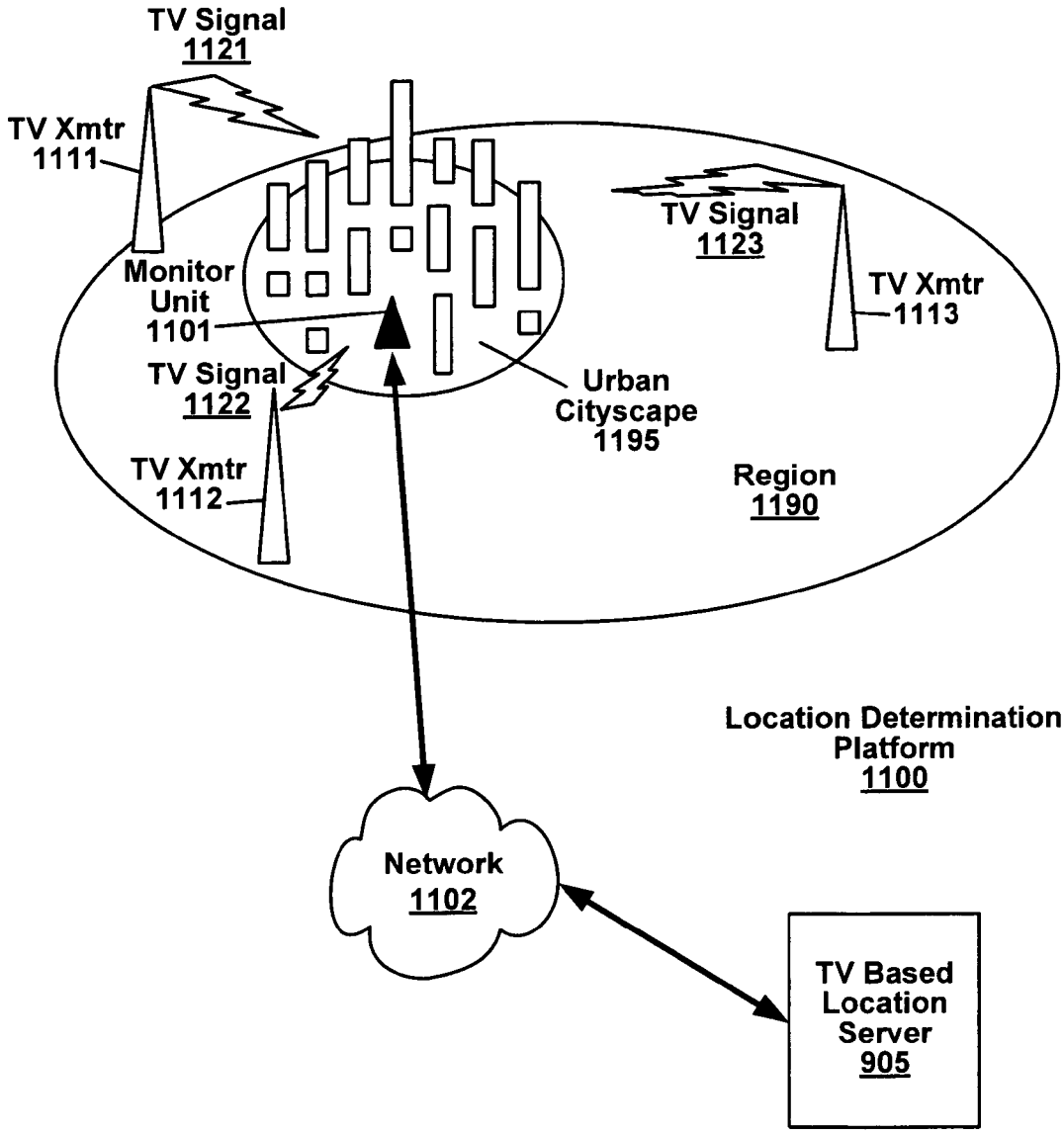
FIG. 11 depicts an exemplary television signal based location determining platform, which can be used with an embodiment of the present invention.

FIG. 11 depicts an exemplary television (TV) signal based location determination platform (TV platform) 1100, which can be used with an embodiment of the present invention. A geographic region 1190 includes within it a densely developed urban cityscape 1195 and TV transmitters 1111, 1112 and 1113 which respectively broadcast TV signals 1121, 1122 and 1123. It should be appreciated that embodiments of the present invention are well suited to function with a variety of signals.

TV platform 1100 includes a monitor unit 1101, deployed in a fixed position within region 1190. Deployed within urban cityscape 1195, monitor unit 1101 incorporates an antenna and related circuitry that is highly sensitive to TV signals, such as TV signals 1121, 1122 and 1123 that permeate urban cityscape 1195. Monitor unit 1101 monitors TV signals 1121, 1122 and 1123, analyzes information sensed therefrom that relates to their stability, timing, phasing, strength, etc. Monitor unit 1101 reports these data and related information to TV based location server 905, with which it is coupled via network 1102, which in one implementation includes the Internet.

TV based location server 905 receives the monitor data relating to TV signals 1121, 1122 and 1123 from monitor unit 1101 and processes these data into location related information, sometimes referred to as aiding information. With reference again to FIGS. 9 and 10, the aiding information can be provided to position determining device 901 as SMS messages, via network 902, SMS gateway 903 and network 904. Position determining device 901 uses this aiding information to determine pseudo ranges to TV transmitters 1111, 1112, and 1113 using TV measurement module 1030. In embodiments of the present invention, device 901 then sends the pseudo ranges to TV transmitters 1111, 1112, and 1113 to TV based location server 905 which then computes the geographic position of position determining device 901 using this pseudo range information. It is noted that TV based location server 905 may utilize additional positioning information. For example, GNSS pseudo range information from device 901 (if available), or cellular network antenna information used to communicate with network 902, may be used by TV-based location server 905 in order to determine the region (e.g., 1190) in which device 901 is currently located. In embodiments of the present invention, TV based location server 905 may send the geographic position data to 901, or to a service provider (e.g., service provider 204 of FIG. 2). In embodiments of the present invention, the geographic position data may be used to control an operational state of device 901 as described above.

Embodiments of the present invention are advantageous in determining the position of device 901. For example, upon detecting motion, device 901 attempts to generate of position fix. As described above, in certain conditions, such as when signals to GNSS satellites may be blocked or impaired, device 901 may fail to generate an acceptable GNSS position fix. In embodiments of the present invention, an acceptable position fix may comprise a position fix in two dimensions (e.g., latitude and longitude), or three dimensions (e.g., latitude, longitude, and altitude). Typically, determination of whether a position fix comprises an acceptable position fix is performed by TV based location server 905. For example, device 901 may determine its position in two dimensions and send a position report to TV based location server 905. However, TV based location server 905 may determine that a three dimensional position fix is needed and that the two dimensional position fix is therefore not acceptable.

Exemplary Process Support Architecture

Figure 12:
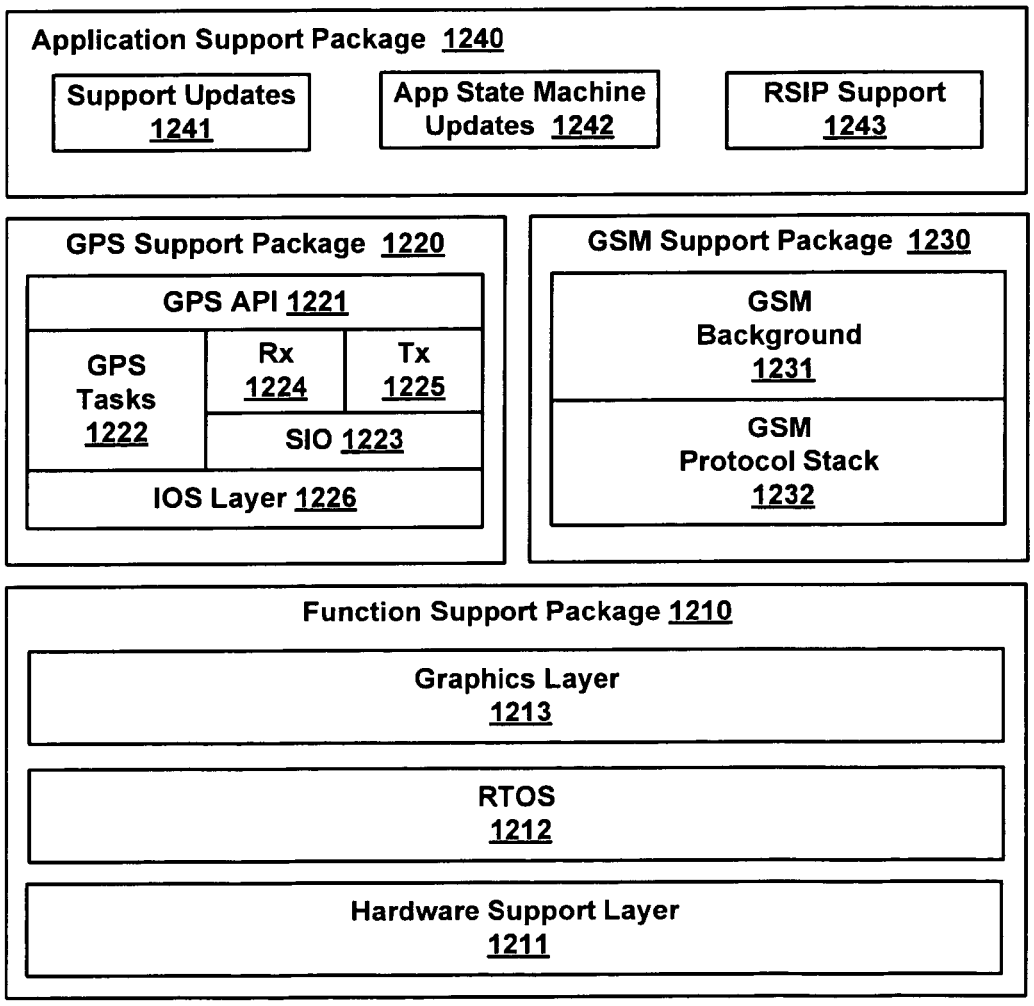
FIG. 12 depicts an exemplary process support architecture, according to an embodiment of the present invention.
Figure 14:
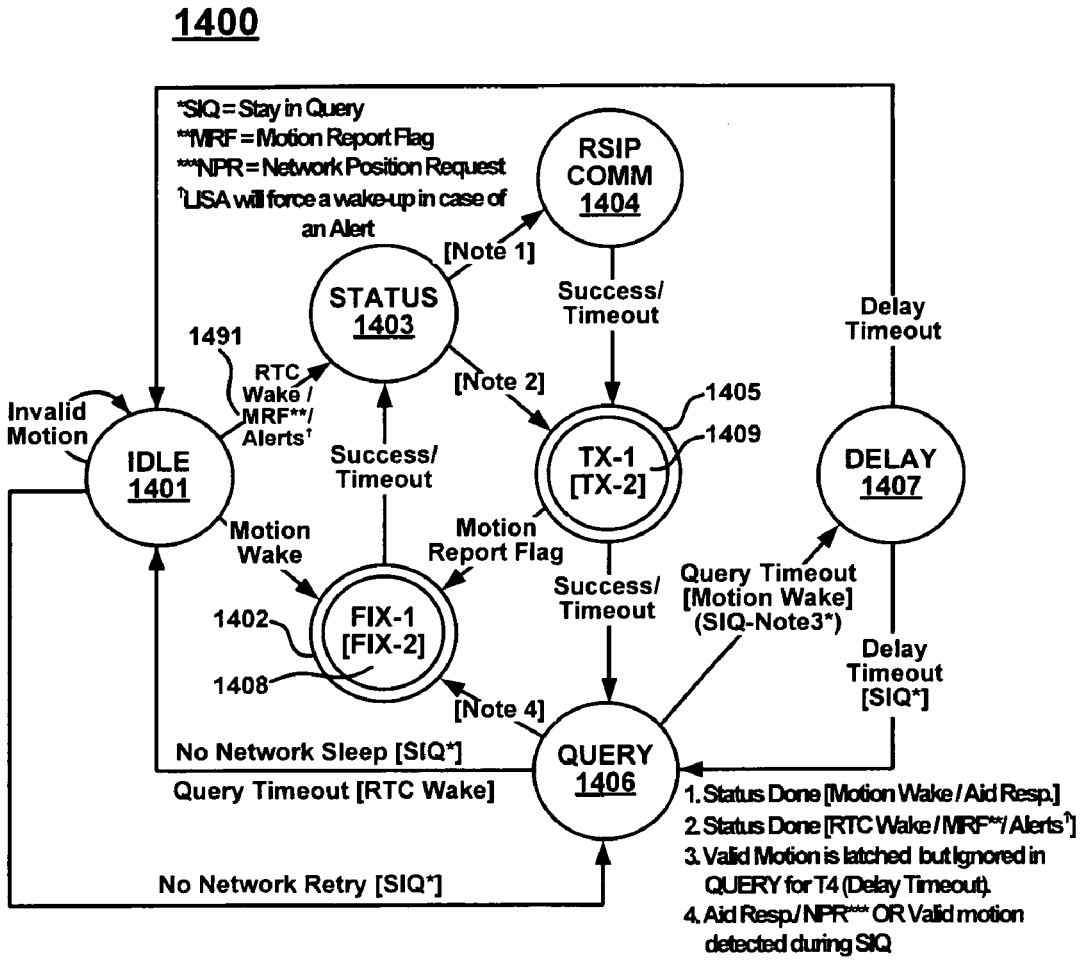
FIG. 14 depicts another exemplary state machine, according to an embodiment of the present invention.

FIG. 12 depicts an exemplary process support architecture 1200, according to an embodiment of the present invention. FIG. 12 is described with reference to FIG. 10 as well. Process support architecture 1200 allows implementation of a state machine (e.g., state machine 1400; FIG. 14) with which aiding information based, for instance, on TV based location related pseudo range data for controlling location determining device 901. Elements of process support architecture 1200 comprise, in various embodiments, software, hardware, firmware and combinations thereof related to the function and interactions between TV measurement module 1030, GPS receiver 1010 and GSM modem 1020, described above with reference to FIG. 10.

A function support package 1210 comprises a hardware support layer 1211, which help enable location determining device 901 to function an electronic device as discussed in Section I above. A real time operating system (RTOS) 1212 allows real time processing functions and a graphics layer 1213 allows processing of graphics related information. A GSM support package 1230 includes a background module 1231 and a GSM protocol stack 1232. GPS support package 1220 includes a GPS application program interface (API) 1221, a GPS tasking module 1222, a serial interface operating (S10) module 1223, receiver module 1224 and transmitter module 1225.

An internetworking operating system (IOS) layer 1226 supports creation of dynamic tasking related to the GPS functionality of device 901. Application support package 1240 manages function support package 1210, GSM support package 1230 and GPS support package 1220, in one embodiment, such as with respect to when they are enabled and disabled and the order in which they perform operations.

SIO mapping layer module 1223 functions as a driver and interrupt handler for serial port 1035, with which in one embodiment TV measurement module 1030 is coupled to device 901. Communication between TV measurement module 1030 and device 901 is based in one embodiment upon RSIP™. TV measurement module 1030 provides data communication functionality and, in one embodiment, communicates in response to command packets sent out by host processor 1051.

Figure 13:
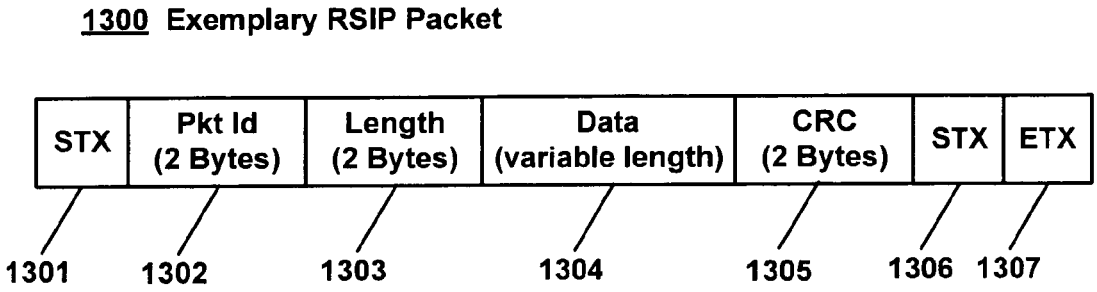
FIG. 13 depicts an exemplary message packet, according to an embodiment of the present invention.

In one embodiment, TV measurement module 1030 communicates with the other components of device 901 in the form of message packets. FIG. 13 depicts an exemplary message packet 1300, according to an embodiment of the present invention.

Each packet starts with a start-of-text (STX) character 1301, which is followed by four non-optional fields, three of fixed length. STX character 1301 is followed by a two-byte packet identifier field 1302. Packet identifier field 1302 comprises 16 bits of data, sent most significant bit (MSB) first, and guides interpretation of data field 1304.

A two byte length field 1303 contains the data related to the number of bytes in the data field 1304, which is measured to the end of the packet starting at the next byte and excluding CRC field 1305. The data in length field 1303 comprises a 12 bit number and is sent MSB first. A high nibble of the first byte of the length field 1303 has a checksum value based upon an exclusive OR logic function performed upon the three nibbles of the field. The length of data field 1304 can vary and can contain data relating to aiding information or other functions of TV measurement module 1030.

Field 1305 comprises a 16 bit cyclic redundancy check (CRC) value created with the application of a computer implemented CRC calculation process to the characters from packet identifier field 1302 up to the start of CRC field 1305, e.g., at the end of the data field 1304. The bytes comprising CRC field 1305 are not included in the CRC calculation. To avoid false packet detection, the CRC field 1305 is followed by a stuffing STX packet 1306, which is not included in the CRC calculation and which is added prior to sending packet 1300 and removed after receiving the packet. After CRC field 1305, packet 1300 ends with an end-of-text (ETX) sequence 1307.

Packet 1300 can comprise one of several different packet types to effectuate various communications between TV measurement module 1030 and the other components of device 900. An echo command packet commands TV measurement module 1030 to echo back four bytes sent with a particular packet. TV measurement module 1030 responds to an echo command with an echo response packet. A status command packet commands the TV measurement module to send back data related to its readiness for performing a particular function. TV measurement module 1030 responds to a status command with a status response packet.

An SMS command is used by device 901 to send last added increment (LAI) positional information and other GPS fix data or to send a received aiding information packet received with the TV measurement module 1030 from TV based location server 905 along with GPS pseudo ranges. The SMS command packet is also used to convey a unique sequence number that is incremented for every cycle (e.g., 'Fix' or 'Status'; FIG. 14). An SMS response packet is a packet in response to an SMS command packet. SMS response packets contain aid requests or measurement response data in base 64 encoding, e.g., by application support package 1240.

With reference again to FIG. 12, application support package 1240 comprises an update support module 1241. Update support module 1241 allows components of device 901 to exchange and transfer data according to standards such as the American Standard Code for Information Interchange (ASCII). In one embodiment, update support module 1241 supports the Trimble ASCII Interface Protocol™ (TAIP™). RSIP support module 1243 allows components of device 901 to exchange information using the RSIP™ protocol, as discussed above.

Application state machine and update support module 1242 allows device 901 to be operated as a state machine. Thus, application support package 1240 operates device 901, in one embodiment, as a state machine, which is persistent over power cycles. Thus, when device 901 "wakes up" from a programmed sleep period or other period of device inactivity, the device can "be aware" of its then-current state and "know" what function or step to perform next.

Exemplary State Machine for Position Determination

FIG. 14 depicts another exemplary position determination application state machine 1400, according to an embodiment of the present invention. In one embodiment, device 901 implements state machine 1400 with mechanisms similar to those discussed above with reference to FIG. 3. State machine 1400 has, in one embodiment, seven (7) states that represent (e.g., model, correspond to, etc.) a current (e.g., with respect to time) operational state (e.g., operating mode, functional condition, etc.) of position determining device 901.

Depending on the application configuration, the operation of state machine 1400 can "center" around an 'IDLE' state 1401, or a 'QUERY' state 1406. In the IDLE state 1401, the location determining device 901 remains for the most part in a power down state (e.g., 'sleep'), until it is "excited" with, e.g., a motion wakeup, real time clock (RTC) wakeup event or the like. In the QUERY mode 1406, device 901 spends a significant amount of time in a querying state, effectively logged on to GSM network 902 (FIG. 9) and essentially "waiting" to receive SMS messages therewith, e.g., from TV based location server 905.

Exemplary IDLE State

The IDLE state 1401 corresponds to the state that device 901 enters when it goes to sleep (e.g., temporarily halts most power consuming operations), such as waiting for an indication of motion or an RTC timeout. While in the idle state 1401, essentially all hardware is turned off except for the motion sensor, motion sensor wakeup logic, and the RTC. Either of the motion sensor wakeup logic and the RTC can awaken device 901 (e.g., restore it to a state other than IDLE state 1401).

When device 901 enters the IDLE state 1401, it checks if there was motion detected, for instance during the 'DELAY' state 1407, with a reading of a motion latch. If motion is detected therewith, device 901 transitions effectively immediately to a 'FIX-1' state 1402, wherein other checks are bypassed. When device 901 enters the IDLE state 1401 and no motion is detected to have occurred during the DELAY state 1407, device 901 is programmed to wakeup a time T1 seconds later and enables the motion sensor. Device 901 then effectively powers down; it powers off essentially all hardware components and waits for a motion or RTC wakeup.

Upon waking, device 901 first checks to determine which stimulus woke it up. Where device 901 woke up in response to motion detected, the state machine 1400 waits for a time T7 seconds and performs a computer implemented filtering process wherein the detected motion is validated. If a valid motion is indicated task within the duration of time T7, the application state machine 1400 transitions to the next state. However, if the detected motion is determined not to be valid (e.g., insignificant motion), the application state machine 1400 reverts to IDLE state 1401 sleep for the remainder of time T1.

With a validated motion, what the next state will be depends on whether a motion report flag (MRF) 1491 is set or not. Where MRF 1491 is set, the application state machine 1400 transitions to a 'STATUS' state 1403. If MRF 1491 is not set, state machine 1400 transitions to a 'FIX-1' state 1402. Where an RTC alarm (e.g., upon a programmed timeout of the RTC wakeup function of processor 1051), device 901 transitions to STATUS state 1403. TV measurement module 1030 can also assert a wakeup to awaken device 901, for instance upon a change in its detected power state and/or upon receipt of an alert.

Where device 901 awakens due to an assert by the TV measurement module 1030, the state machine 1400 transitions to the STATUS state 1403, wherein it resets the one or more events and takes corresponding appropriate action. For instance, upon detecting a power failure event, TV measurement module 1030 awakens device 901 and state machine 1400 transitions to STATUS state 1403 to allow device 901 to ascertain its status and take corresponding ameliorative action. In one embodiment, other alerts received with TV measurement module 1030 are also processed.

Exemplary GPS FIX ("FIX-1") State The 'FIX-1' state 1402 essentially corresponds to a GPS FIX state wherein the GPS engine of GPS receiver 1010 (FIG. 10) is running and trying to get a fix (e.g., determine a valid position using GPS functionality), as described above in Section I. While in FIX-1 state 1402, the hardware components related to GPS position determining functionality are turned on and other hardware components such as the GSM modem 1020 are turned off, which aids with efficiently husbanding, conserving and otherwise economizing on power and computational resources.

When device 901 enters the FIX-1 state 1402, it enables the GPS receiver 101 and related hardware components, sets a timer function (e.g., of processor 1051) to a time value of T2 and starts the GPS tasking module 1222 (FIG. 12). Application support package 1240 configures the GPS tasking module 1222 with any stored GPS parameter settings. Application state machine 1400 then periodically checks the GPS tasking module 1222 for a GPS fix status. If a fix is thus achieved, then the position is extracted, the RTC is updated, and the device 901 exits the FIX-1 state 1402 and transitions to STATUS state 1403.

Where either a position fix is achieved or an RTC timer timeout occurs, device 901 transitions to the STATUS state 1403 after disabling the GPS tasking module 1222 and powering off GPS receiver 1010 and related hardware. The GPS information is stored into a report structure to be used during the TX-1 state 1405. A computer implemented process determines whether the quality of the GPS fix suffices (e.g., is "acceptable") to use based on horizontal positioning (e.g., type 2D) or terrain based positioning (e.g., type 3D). In embodiments of the present invention, this determination may be made by device 901 itself, or by, for example, TV based location server 905. However, if device 901 determines that a failure to generate an acceptable GPS fix has occurred, or a non-existent GPS fix almanac in memory 1052 or another non-volatile random access memory (NVRAM) such as can occur with a first time boot, in one embodiment it stays in the FIX-1 state 1402 to collect GPS almanac and ephemeris data. In one embodiment, device 901 leaves the GPS engine running even after a valid GPS fix is achieved but before transitioning to the STATUS state 1403 to allow for the collection of up to date almanac and ephemeris data on pre-programmed time intervals such as, for example, every 6 hours.

Exemplary STATUS State

State machine 1400 goes to the 'STATUS' state 1403 upon occurrence of an RTC timeout during the IDLE state 1401 and after the FIX-1 state 1402 is complete. While in this STATUS state 1403, both the GSM modem 1020 and the GPS receiver 1010 and related hardware components are typically turned off. Upon entering the STATUS state 1403, device 901 retrieves the power related data such as battery status information and stores this information in a report structure to be used during the TX-1 state 1405 and the motion latch is cleared.

Where the application state machine 1400 entered the STATUS state 1403 from the FIX-2 state 1408, it transitions to the TX-2 state 1408. However, where the application state machine 1400 entered the STATUS state 1403 from another state (e.g., from FIX-1 state 1402 or IDLE state 1401, state machine 1400 transitions to the TX-1 state 1405. Qualifying events or alerts that occur, happen, are received, etc. after the STATUS state 1403 but before transit to the TX-1 state 1405 cause the application state machine 1400 to undergo a fresh status report cycle. The resulting status information however is not processed or reported in states TX-1 (1405) or TX-2 (1409).

Exemplary Serial Communicative RSIP COMM State

In the serially communicative 'RSIP COMM' state 1404, the application state machine 1400 enables power for TV measurement module 1030 and effectively tries to communicate therewith. Two instances place application state machine 1400 into the RSIP COMM state 1404. First is to convey GPS fix information to the TV measurement module 1030, which then packetizes that information into an aid request packet 1300 (FIG. 13) for transmission to the TV based location server 905 (FIG. 9). Second is when an aid response/measurement request from, for example, TV based location server 905 is received by the application state machine in the 'QUERY' state 1406, which is passed on to the TV measurement module 1030. The TV measurement module 1030 then completes a TV signal measurement cycle and responds with a measurement response packet 1300.

In one embodiment, RISP COMM state 1404 functions according to a general sequence of operation wherein the GSM modem 1020 and related hardware components are powered on to allow for the most recent LAI of the GSM network to be recorded, whereupon the GSM modem 1020 and related radio hardware components are powered off (except e.g., for an aid request cycle in which the GSM modem 1020 is kept on through the TX-1 state 1405).

The TV measurement module 1030 is powered on and a RSIP status (or echo) message is sent thereto. Other components of device 901 (e.g., processor 1051, GPS receiver 1010) start a timer with a programmed timeout value and expect to receive the RSIP status (or echo) response from the TV measurement module 1030 before expiration thereof, such as to confirm that the TV measurement module 1030 is powered up and operational. If the TV measurement module 1030 fails to reply within the programmed timeout value, then a TV measurement module status flag (e.g., in a register of processor 1051) is set to 'Failure' and the failure thereof is reported back to the TV based location server 905.

Upon entering STATUS state 1403 from the FIX-1 state 1402 or the 'FIX-2' state 1408, the application state machine 1400 sends a RSIP SMS command packet to the TV measurement module 1030 and expects to receive back a corresponding RSIP SMS response packet 1300 within the timeout period. The packet 1300 is then formatted into appropriate report structures such as 'msg: SMS AidReq' and/or 'msg: SMS MeasurementResp' to be used during the TX-1 state 1405 and the TX-2 state 1409, respectively. Where TV measurement module 1030 fails to reply within the timeout period, then the application sets the TV measurement module status flag to 'Failure,' and stores it in the report structure to be used during the TX-1 state 1405. State machine 1400 then transitions to the TX-1 state 1405 or the TX-2 state 1409, as appropriate.

Exemplary Transmissive TX-1 State

In the transmissive TX-1 state 1405, state machine 1400 functions to send SMS blocks in RSIP packets 1300 from TV measurement module 1030 and related status information to TV based location server 905. During TX-1 state 1405, the GPS receiver 1010 and TV measurement module 1030 and related hardware components are powered off and the GSM modem 1020 is powered on.

When device 901 enters TX-1 state 1405, the GSM modem and related radio hardware components are powered on. Device 901 then starts a timer (e.g., associated with the RTC functionality of processor 1051) with programmed timeout value and starts the GSM protocol stack 1232. The status information is provided to the application support package 1240, which returns the protocol message to be sent. The SMS block 1300 received from TV measurement module 1030 is then encoded. In one embodiment, base-64 encoding is used for encoding the SMS block 1300 from TV measurement module 1030. The device 901 then waits for the GSM protocol stack 1232 to report that it has registered on the SMS network 902.

In the event that device 901 is new (or e.g., recently repaired, refurbished, etc.), the device may behave in certain respects as though values or identities are to be established. For instance, device 901 in one embodiment is initially programmed and/or components therein are configured using an external provisioning module, unit, functionality, etc. with which it is decouplably connected. In this way, initial settings, values, configurations, states, etc. can be made to device 901. Where the GSM protocol stack 1232 "asks for" (e.g., requests, demands, etc.) a value such as a personal identity number (PIN) to allow access to a subscriber identity module (SIM) for communicatively accessing network 902 and the value in storage in such a provisioning module has not been used unsuccessfully, that value will be tried. If the value is rejected, it will be remembered so that it is not tried again until the value is changed using a provisioning command.

Once device 901 registers on the SMS network 902, it sends the protocol message or the base-64 encoded SMS message packet 1300 to the TV based location server 905 and waits for conformation from the GSM protocol stack 1232 that it was sent. In the event that a wakeup was due to motion and the motion report flag is set, the device 901 transitions to the GPS FIX-1 state after it has sent the status information to the TV based location server 905. In other cases, device 901 transitions to QUERY state 1406 when the GSM protocol stack 1232 reports a successful sending of the message. Where the RTC timer signifies that a pre-determined time parameter has expired before the successful transmission occurs, the state machine 1400 transitions to the Query state 1406.

Exemplary QUERY State

In the 'QUERY' state 1406, application support package 1240 waits for incoming messages from the TV based location server 905. During QUERY state 1406, GPS receiver 1010 and TV measurement module 1030 are powered off and GSM modem and related radio components are powered on. When device 901 enters the QUERY state 1406, it starts a timer with a pre-programmed timeout value. Application support package 1240 then waits until the timeout value expires or a message arrives, e.g., from TV based location server 905 via networks 902 and 904, etc.

If a message arrives it is passed to the RSIP support module 1243, which may return one or more messages to send in response to the query. If the message is an SMS aid response and measurement request, then the device 901 transitions to FIX-2 state 1408 to start a position fix cycle. If the message is a network position TAIP™ request, then the device 901 transitions to the FIX-1 state 1402. For each of the TAIP™ responses the application support package 1240 sends responsively to the server 905, it waits for a confirmation from the GSM protocol stack 1232 that they were sent.

Where application support package 1240 is sending responses to the query, it will continue to send the responses and accept new queries. If there are no messages waiting to be sent then state machine 1400 transitions to the 'DELAY' state 1407, where the wakeup was due to motion. If however, the wakeup was due to the RTC, then the state machine 1400 transitions to the IDLE state 1401.

Where the wakeup is due to motion, the application state machine 1400 starts a new (e.g., RTC based) timer set for a given duration (e.g., a Delay timeout), during which any valid motion will be latched but not acted upon. The device 901 continues to listen for incoming messages and will act appropriately upon any messages received. At the end of the delay timeout, if motion was latched, application state machine 1400 immediately transitions to FIX-1 state 1402. Otherwise, application state machine 1400 remains in QUERY state 1406. The device 901 stays in the Query state 1406 until either (1) a message such as an aid response or a network position request arrives via GSM network 902, or (2) coupling of device 901 with GSM network 902 is lost.

If coupling of device 901 with the GSM network 902 is lost for any reason (e.g., device 901 may be traveling through a long submarine or intramountain tunnel or a similarly radio-constrained milieu), then the device 901 attempts to reacquire the network 902 until a timeout for reacquiring the network has expired. Upon expiration of the timeout, the application state machine 1400 transitions to the IDLE state 1401 and effectively sleeps, and programs the RTC to wakeup after a period of a time. Typically, at the end of the sleep period, the unit will wakeup (e.g., an RTC wakeup) and transitions directly to QUERY state 1406 and retries acquiring the GSM network 902 for another time period. In one embodiment, this cycle is repeated until the GSM network 902 is re-acquired or for a predetermined number of re-acquisition attempts such as a maximum of, for example, 10 attempts. In this example, after 10 network 902 re-acquisition attempts, the device 901 will transition to the IDLE state 1401 and sleep for a period of time.

Exemplary DELAY State

After a wakeup cycle, where the motion sensor input is ignored (e.g., as invalid, etc.), state machine 1400 effectively "sits" (e.g., loiters, lingers, waits, etc.) in a 'DELAY' state 1407. In the DELAY state 1407, the device is restricted from reporting more often than the duration of a pre-programmed, preset DELAY interval. During DELAY state 1407, essentially all hardware components of device 901 are powered off, except for the RTC. When device 901 enters DELAY state 1407, it disables the GSM protocol stack 1232 and turns off the GSM modem 1020 and related hardware components. It then programs the RTC timer to wakeup after the expiration of the DELAY interval and disables the wakeup logic associated with the motion sensor. With virtually all its hardware components deenergized except the wakeup logic associated with the RTC, device 901 effectively sleeps until it awakens with an RTC wakeup after the passage of the DELAY interval, whereupon it transitions to the IDLE state 1401.

Exemplary Fix ("FIX-2") State

State machine 1400 performs fix related functions in 'FIX-2' state 1408 that are similar in some respects to those performed in FIX-1 state 1402. In one embodiment, functions of the FIX-2 state 1408 are substantially similar to functions of the FIX-1 state 1402, although the acquisition of satellite pseudo ranges, in contrast to an actual satellite-based position fix, is somewhat more significant in the FIX-2 state 1408. The satellite pseudo ranges may be used by TV-based location server 905 to aid in determining the position of device 901.

In one sense, application state machine 1400 places position determining device 901 in the FIX-2 state 1408 because a sufficiently accurate or precise GPS fix was not acquired in an "earlier" (e.g., with respect to the cycling of state machine 1400) FIX-1 state 1402. Thus, from the perspective of the functional operation of device 901, there is a significant possibility that, while acquiring the satellite pseudo ranges, the FIX-2 state 1408 will also be unable to generate a reliably accurate and/or precise GPS fix. In one embodiment, processing resources are conserved by refraining from the attempted calculation thereof in the FIX-2 state 1408. In one embodiment, the FIX-2 state 1408 functions to acquire pseudo ranges from any visible satellite and pass the information related thereto to the TV measurement module 1030.

Application state machine 1400 transitions to the FIX-2 state 1408 upon receipt of an SMS aid response/measurement request from the TV based location server 905, signifying a request for a position fix. In one embodiment, the timeout duration for FIX-2 state 1408 differs from that of FIX-1 state 1402, and in one implementation is on the order of 60 seconds. Upon entry into the FIX-2 state 1408, the GSM protocol stack 1232 is disabled and the GSM modem 1020 and related component hardware is turned off. The GPS receiver 1010 and related component hardware is enabled. GPS pseudo ranges are then acquired within a timeout period corresponding to a pre-determined timeout interval. After expiration of pre-determined timeout interval, state machine 1400 transitions to STATUS state 1403 and GPS receiver and related hardware is powered down.

Exemplary Second Transmissive (TX-2) State

In one embodiment, position fix information, generated with the functionality performed in the FIX-2 state 1408 is sent by device 901 in a second transmissive state such as TX-2 state 1409. Functionally, the TX-2 state 1409 is similar in certain respects to the TX-1 state 1405, although their respective timeout values and the nature of the information respectively transmitted in each state may differ. For instance, in one embodiment, the timeout value of TX-2 state 1409 is different from the timeout value characterizing the TX-1 state 1405. Further, in the present embodiment no TAIP™ protocol message is typically generated during the TX-2 state 1409.

One purpose of the TX-2 state 1409 is the transmission of an SMS block 1300 from TV Measurement module 1030, which contains a measurement response that comprises information from both GPS and the TV pseudo range measurements. During the TX-2 state 1409, both the GPS receiver 1010 and the TV measurement module 1030 and related component hardware are powered off and the GSM modem and related radio component hardware is powered on. The state machine 1400 moves to the QUERY state 1406 when the GSM protocol stack 1232 reports a successful sending of the SMS message 1300, containing the pseudo range data. In the event that the RTC's T23 timer functionality expires before successful transmission, the state machine 1400 transitions to the QUERY state 1406.

Figure 15:
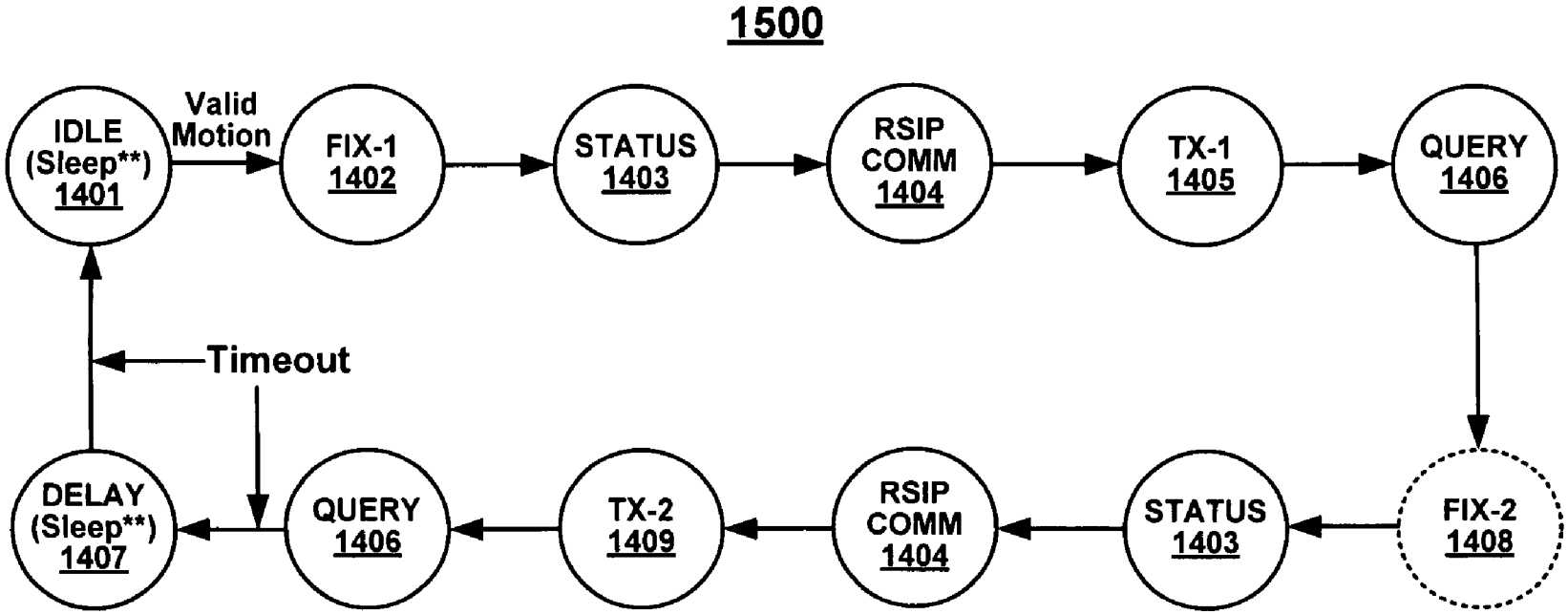
FIG. 15 depicts an exemplary operational state transition flow, according to an embodiment of the present invention.

FIG. 15 depicts an exemplary operational state flow 1500, according to an embodiment of the present invention. Operational state flow 1500 allows position determination based on GPS based pseudo ranges and TV based pseudo ranges. The state transition diagram shown in FIG. 15 depicts an exemplary flow cycle of the application state machine 1400 in the case of an unacceptable GPS position fix (e.g., one lacking sufficient precision, accuracy, etc., as may occur in locales other than open terrain such as dense urban environments, within buildings, etc).

From IDLE state 1401, state machine 1400 awakens with a valid motion detection wakeup and transitions to FIX-1 state 1402, in which a GPS fix is attempted. State machine 1400 then transitions to the STATUS state 1403, in which it gathers certain hardware related information (e.g., battery status, etc.) relating to the operation of device 901. From STATUS state 1404, state machine 1400 transitions to a first RISP COMM state 1404. In RISP COMM state 1404, state machine 1400 enables power to TV measurement module 1030 and attempts to establish communications therewith. Operational state flow 1500 then advances, as state machine 1400 transitions to the TX-1 state 1405.

In TX-1 state 1405, GPS position information, which was obtained while trying to obtain a GPS based fix in FIX-1 state 1402, is sent as part of an aid request packet 1300 to the TV based location server 905. The TV based location server 905, based on the contents of the aid request packet 1300 (e.g., where the GPS fix attempt of FIX-1 state 1402 is unsuccessful), initiates a terrestrial based positioning function in operational state flow 1500 with the sending of its aid response. In one embodiment, both TV based location server 905 and TV measurement module 1030 are state-less. Thus, if an aid request or aid response message 1300 is lost, it does not affect the quality of the TV measurements or the position calculation based thereon.

Operational state flow 1500 advances as state machine 1400 transitions to QUERY state 1406, in which incoming messages 1300 are awaited from TV based location server 905. If an Aid Response packet is not received in QUERY state 1406, state machine 1400 times out and transitions to DELAY state 1407, as discussed above with reference to FIG. 14. Where multiple aid response packets 1300 (and/or TAIP™ query and set messages) are queued up at the SMS gateway 903 that are destined for device 901, they are received thereby one at a time.

For instance, upon receipt of an aid response, application state machine 1400 transitions to the next state (e.g., FIX-2 state 1408) without waiting to see if there are any more SMS messages to be received. Aid responses whose protocol sequence number does not match the current sequence number of the application TAIP™ message 1300 (e.g., corresponding to the TAIP™ message generated in TX-1 cycle 1405) can be discarded. Thus, where one or more TAIP™ messages are received before an aid response is received, the TAIP™ messages are acted upon and appropriate responses sent before the aid response is received and processed. In one embodiment however, reception of a Network Position Request (NPR) command from TV-based location server 905 or service provider 204 causes application state machine 1400 to transition to the FIX-1 state 1402, effectively immediately. Notwithstanding this exception, any other TAIP™ or other messages received before the NPR command are processed prior to processing the NPR command.

The TX-1 state 1405 is characterized by the sending of aid request packets. A status report or position report TAIP™ message is sent in TX-1 state 1405 where a qualifying event occurs during the current wakeup cycle. For instance, a qualifying event could be a change in power supply status, such as a disconnection, reconnection or other power availability change, a backup battery status change (e.g., battery low or back to normal), etc. Qualifying events include alerts (e.g., an alert condition change), a change in the status of communication between TV measurement module 1030 and other components of device 901 (e.g., a failure or restoration of intercommunication), certain GPS related errors, and timeout for periodic status reporting during IDLE state 1401.

In the first QUERY state 1406, network LAI information will be captured on exit there from for use in the subsequent RSIP COMM state 1404. Advantageously, this saves time, which can be at a premium, during the FIX state 1409.

Qualifying events or alerts that occur after transition from the first STATUS state 1403 (e.g., before TX-1 state 1405) cause application state machine 1400 to undergo a fresh status report cycle. This information is not processed or reported in TX-1 state 1402 or TX-2 state 1409.

Exemplary Data Flow

Figure 16:
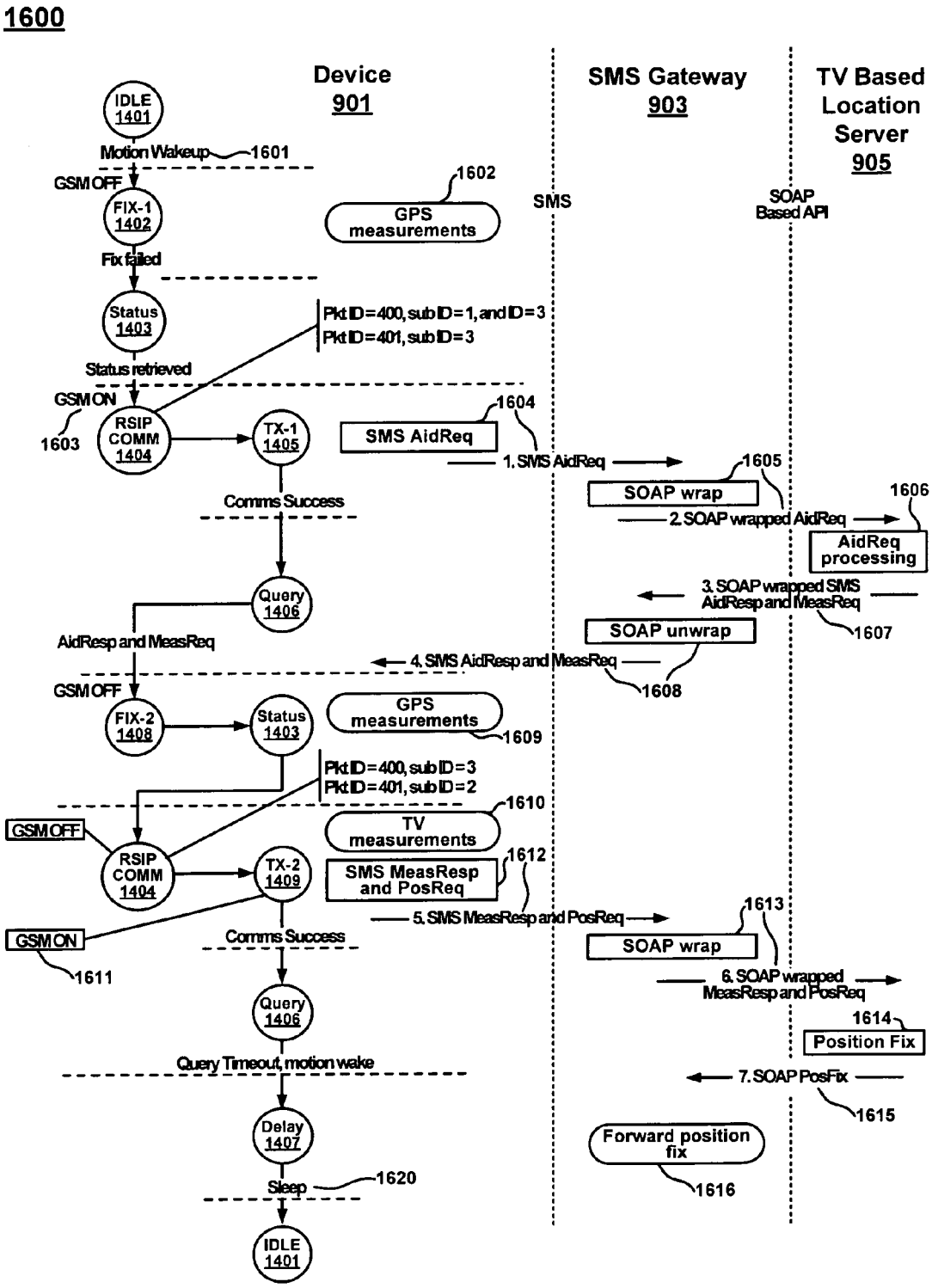
FIG. 16 depicts data flow in a position determining system, according to one embodiment of the present invention.

FIG. 16 depicts data flow 1600 in a positioning system, according to one embodiment of the present invention. Data flow 1600 is described with reference to activity at device 901, SMS gateway 903 and TV based location server 905 (FIG. 9). Data flow 1600 begins with a motion wakeup 1601, with which device 901 awakens from IDLE state 1401. State machine 1400 transitions to FIX-1 state 1402 and performs GPS measurements 1602, which fail to produce an acceptable GPS based fix. State machine 1400 transitions to status state 1403 and retrieves information relating to device 901, such as battery charge condition and the like.

State machine 1400 transitions to RSIP COMM state 1404 and at 1603 powers up GSM modem 1020. State machine 1400 transitions to TX-1 state 1405 and sends an SMS aid request 1604 to the SMS gateway 903. SMS gateway 903 wraps the aid request into a simple object access protocol (SOAP) based message 1605, which is sent to TV based location server 905. TV based location server 905 processes the aid request and generates a corresponding aid response 1606, which can include a measurement request. TV based location server 905 wraps a responsive SMS aid response and measurement request into a SOAP based aid response and measurement request message 1607, which is sent to the SMS gateway 903.

Upon reporting communications success in relation to sending the aid request 1604, state machine 1400 transitions to QUERY state 1406 and device 901 awaits responsive communications. SMS gateway 903 unwraps the SOAP based aid response and measurement request and sends an unwrapped SMS aid request and measurement response 1608 to device 901. Upon receipt of the SMS aid request and measurement response 1608, state machine 1400 transitions to FIX-2 state 1408 and makes GPS related measurements (e.g., gathers GPS pseudo ranges, etc.) 1609 and performs TV based measurements 1610, including the determination of pseudo ranges to TV broadcast signal sources. State machine 1400 transitions to STATUS state 1403, retrieves information relating to device 901. State machine 1400 transitions to RSIP COMM state 1404 and the GSM modem 1020 is powered up at 1611 as state machine 1400 transitions to TX-2 state 1409.

The GPS measurements 1609 and the TV based measurements 1610 are combined in an SMS measurement response and position request 1612, which is sent to the SMS gateway 903. SMS gateway 903 wraps the measurement response and position request into a SOAP based message 1613, which is sent to TV based location server 905. TV based location server 905 processes the GPS and TV measurements 1609 and 1610, respectively, and generates a resultant position fix 1614, which is wrapped into a SOAP based position fix 1615 and sent to SMS gateway 903. SMS gateway 903 unwraps the SOAP based position fix 1615 and sends a corresponding unwrapped position fix 1616 to device 901.

Upon reporting communications success in relation to sending the measurement response and position request 1612, state machine 1400 transitions to QUERY state 1406 and device 901 awaits responsive communications. Upon receipt of position fix 1616, device 901 can note and report its position to a user. After the timeout associated with the QUERY state 1406 (or e.g., a motion wake), state machine 1400 transitions to DELAY state 1407. Upon sleeping at 1620, state machine 1400 transitions to the IDLE state 1401, concluding data flow 1600.

Exemplary Hardware Interfacing and Power Management

Device 901 comprises various interactive hardware and software components. The interfacing of the various hardware and software can affect the operational behavior of the positioning application. Device 901 has analog to digital (A/D) conversion capability and logic to allow software to measure the battery voltage (e.g., directly). In one embodiment, device 901 is powered with an automotive, marine or similar power source and is effectively powered up at all times. One embodiment incorporates a rechargeable backup battery, which allows device 901 to operate in the event of main power (e.g., automobile battery, etc.) being disconnected.

In one embodiment, the external battery voltage is regulated via a power supply associated with TV measurement module 1030. Thus, the battery measurement is not used while device 901 is powered from the automotive battery source, etc. In the event of main power failure, disconnect, etc., device 901 is switched to the backup battery and the application support package 1240 is notified of main power failure and other power related events. In this situation, battery monitoring informs the application support package 1240 of the backup battery voltage. This information is also passed on to the application server via status messages 1300, and are obtained in the STATUS state 1403.

Figure 17:
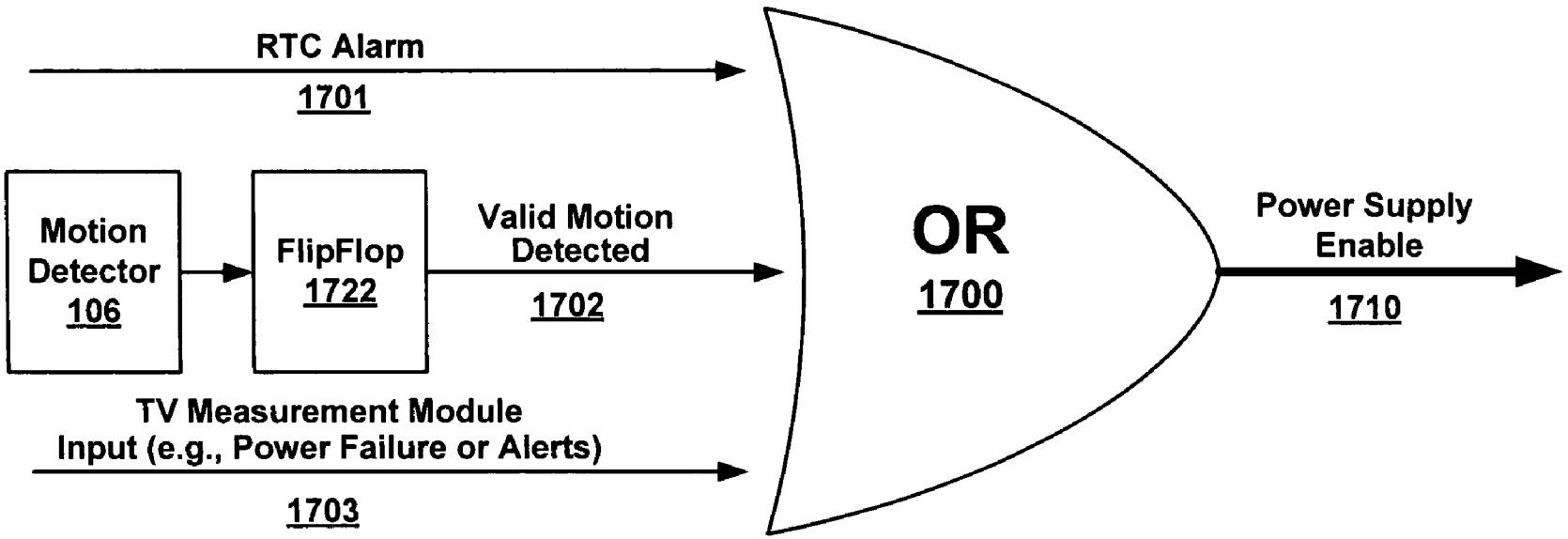
FIG. 17 depicts wakeup logic, according to an embodiment of the present invention.

In one embodiment, device 901 conserves power by keeping most of its logic in a powered down state except for the RTC and wakeup logic. FIG. 17 depicts wakeup (e.g., power up) logic 1700, according to an embodiment of the present invention. Wakeup logic 1700 comprises an OR gate with three inputs. Upon receipt of any of the three inputs, its output enables the power supply for the rest of the hardware of device 901. Inputs to wakeup logic 1700 comprise a RTC alarm 1701, a valid motion detection input 1702, and a TV measurement module input 1703 from TV measurement module 1030 in relation to a power failure sensed by that module (e.g., a backup battery associated therewith) and/or any of various alerts generated by the module.

Thus, upon booting up, device 901 determines which source woke it up and acts accordingly. Wakeup logic 1700 provides the control over power shutdowns for device 901, including all power-draining circuits. The wake up sources including the RTC alarm 1701 and valid motion detection input 1702 remain powered up and operational. In one embodiment, motion detector logic 1702 can be temporarily disabled in DELAY state 1407.

Motion detector 106 is based in one embodiment upon a passive switch (e.g., a mercury actuated switch, etc.) or a substantially similar device, a magneto-resistive motion detector, an accelerometer or another acceleration sensor, a tilt sensor, a vibration sensor, a rotation sensor, a gyroscope, an interferometer, and a motion sensor. The output of motion sensor 106 is latched in one embodiment with a latch, a bistable multivibrator or a similar flip-flop 1722 whose output comprises valid motion detection input 1702 drives the wakeup logic 1700. Flip-flop 1722 can be temporarily disabled with a software controlled general purpose input/output (GPIO).

The RF and signal processing functionalities of GPS receiver 1010 is powered in one embodiment with separate regulation, which is controlled through the application support package 1240. Component circuitry associated with GPS receiver 1010 is powered up during the FIX-1 state 1402 and the FIX-2 state 1408 and is then turned off to save power. Signal processing functionality associated with GPS 1010 communicates with other GPS functionalities (e.g., navigation engine or NAV, etc.) via serial interface. GSM modem 1020 and associated RF functionality are regulated separately under the software based control of GSM protocol stack 1232 and default to off when the device powers on.

Exemplary Process

Figure 18A:
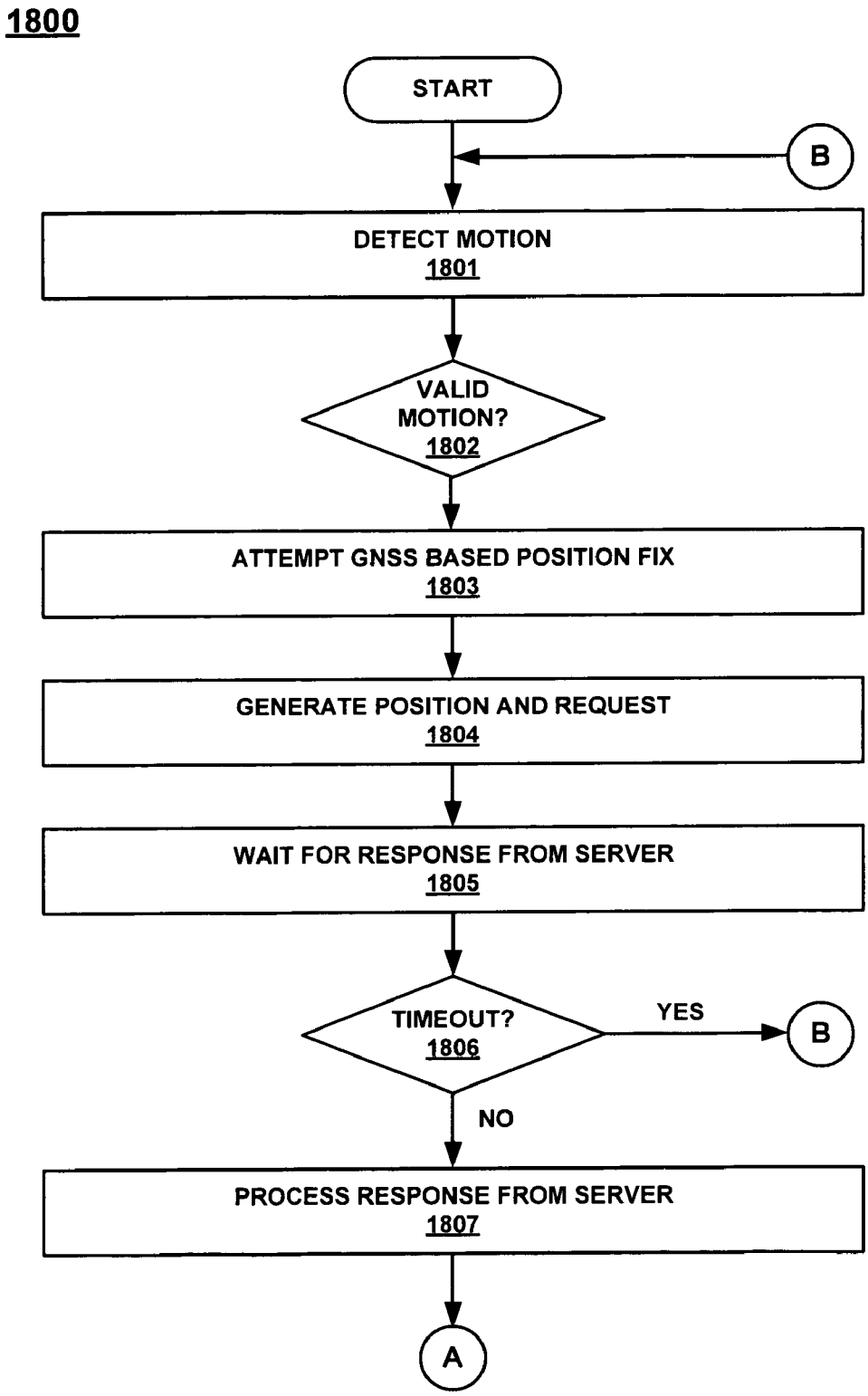
FIGS. 18A and 18B depict an exemplary process for controlling an electronic device, according to an embodiment of the present invention.
Figure 18B:
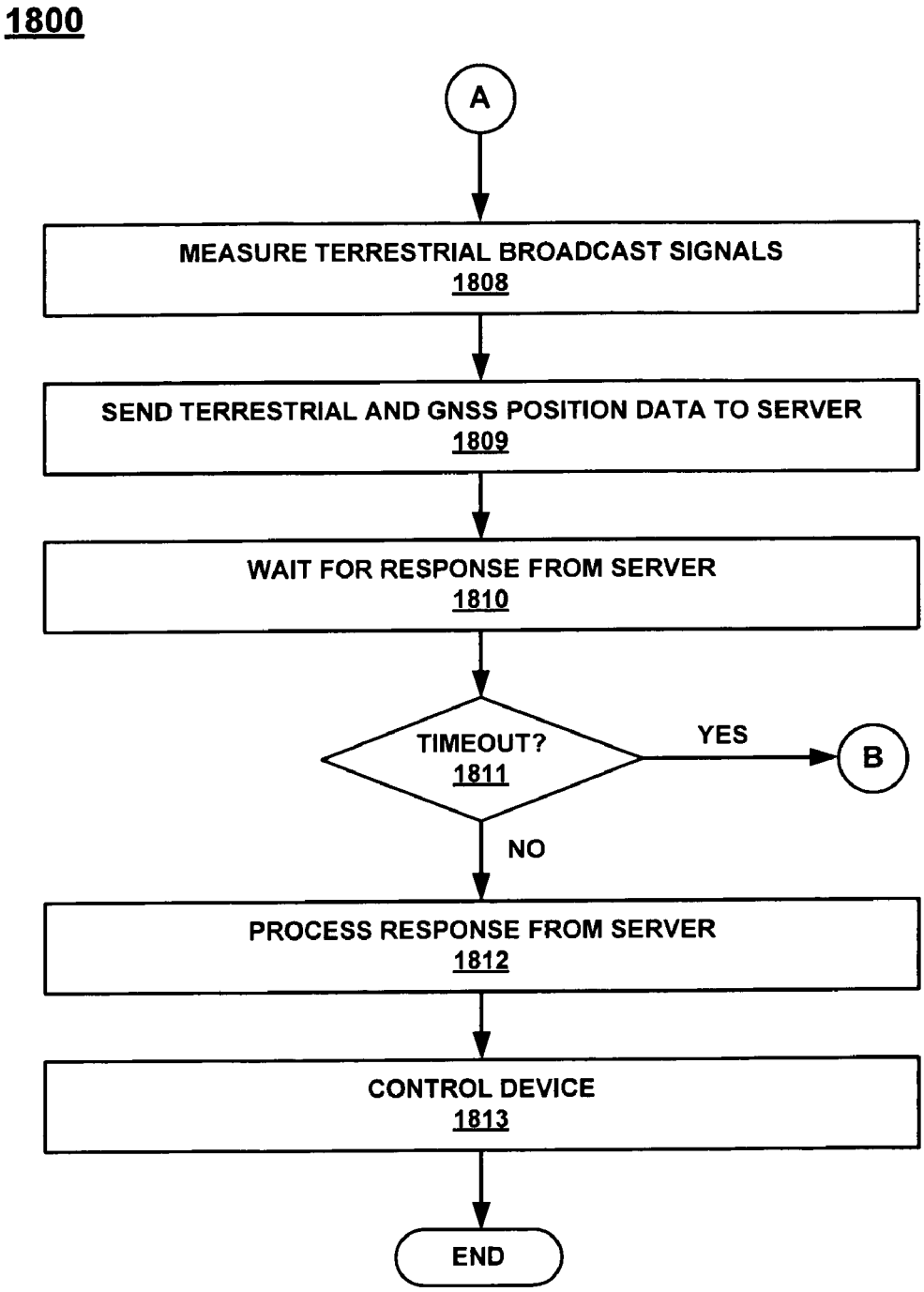

FIGS. 18A and 18B depict an exemplary process 1800 for controlling an electronic device (e.g., position determining device 901; FIG. 9), according to an embodiment of the present invention. Process 1800 begins with block 1801, wherein a motion of the electronic device is detected.

In block 1802, it is determined whether that motion is valid, e.g., significant to the electronic device. If not, process 1800 loops back to its start.

In block 1803, an attempt to generate a GNSS based position fix is made. As described above with reference to FIGS. 2, 3, 5, 14, 15, and 16, embodiments of the present invention will attempt to generate a GNSS based position fix in response to an indication of motion which is significant to the electronic device.

In block 1804, a position fix aid request is generated. As described above with reference to FIG. 16, if device 901 cannot generate an acceptable position fix, it may generate an aid request to TV based location server 905. In embodiments of the present invention, determination of whether an acceptable position fix has been generated may be determined by device 901 itself, or, by TV based location server 905. In embodiments of the present invention, if device 901 successfully generates a GNSS based position fix, process 1800 may proceed to step 1813 wherein the operational state of device 901 is controlled based thereon. In the example of FIGS. 18A and 18B, it is assumed that an acceptable GNSS based position fix has not been generated. As a result, process 1800 has proceeded to block 1804 wherein a position aid request is generated. As described above with reference to FIG. 14, device 901 can enter state RSIP COM wherein power to TV measurement module 1030 is enabled. As described above, in embodiments of the present invention, state RSIP COM may be invoked to packetize GNSS positioning information into an aid request message packet 1300 for transmission to TV based location server 905. Process 1800 then proceed to block 1805.

In block 1805, device 901 waits for a response from TV based location server 905. As described above with reference to FIG. 14, device 901 enters query state 1406. In the example of FIGS. 18A and 18B, process 1800 proceeds to block 1806.

In block 1806, a logical operation is performed in which it is determined whether a timeout period for query state 1406 has elapsed. In embodiments of the present invention, if the timeout period does elapse prior to receiving an aid response/measurement response (e.g., 1608 of FIG. 16), process 1800 returns to idle state 1401. If a response from TV based location server is received prior to the expiration of the timeout period, process 1800 proceeds to block 1807.

In block 1807, an aid response/measurement response is received from TV based location server 905. In embodiments of the present invention, this may include receiving aiding information from TV based location server 905 which facilitates determining pseudo ranges to sources of TV broadcast signals, as well which TV broadcast signals (e.g., 1121, 1122, and 1123) should be measured depending upon the region (e.g., 1190) in which device 901 is located. Additionally, in embodiments of the present invention, device 901 may enter state FIX 2 wherein additional GNSS related measurements are made. In embodiments of the present invention, process 1800 proceeds to block 1808.

In block 1808 terrestrial broadcast signals are measured. As described above with reference to FIG. 14, device 901 may again enter state RSIP COM In embodiments of the present invention, TV measurement module 1030 may utilize the information received in block 11807 to determine pseudo ranges to sources of terrestrial broadcast signals (e.g., TV transmitters 1111, 1112, and 1113 of FIG. 11). In embodiments of the present invention, process 1800 proceeds to block 1809.

In block 1809 the terrestrial position information measured in block 1808, as well as the additional GNSS positioning information gathered in block 1807, is sent in a message packet 1300 to TV based location server 905. In embodiments of the present invention, process 1800 proceeds to block 1810.

In block 1810, device 901 again waits for a response from TV based location server 905. As described above with reference to FIG. 14, device 901 enters query state 1406. In the example of FIGS. 18A and 18B, process 1800 proceeds to block 1811.

In block 1811, a logical operation is performed in which it is determined whether a timeout period for query state 1406 has elapsed. In embodiments of the present invention, if the timeout period does elapse prior to receiving position fix 1616, process 1800 returns to idle state 1401. If a response from TV based location server is received prior to the expiration of the timeout period, process 1800 proceeds to block 1812.

In block 1812, the response from TV based location server 905 is processed. In the example of FIGS. 18A and 18B, TV based location server 905 determines an acceptable position fix of device 901 and sends a position fix back to device 901. Process 1800 then proceeds to block 1813.

In block 1813, the electronic device is controlled according to either the satellite based position fix, or the terrestrial based position fix performed by the electronic device, whichever succeeds. As described above with reference to FIG. 9, upon successfully determining the position of device 901, microprocessor 1051 controls the operational state of device 901 based upon the geo-temporal status which may be stored in memory 1052, thus completing process 1800.

Figure 19:
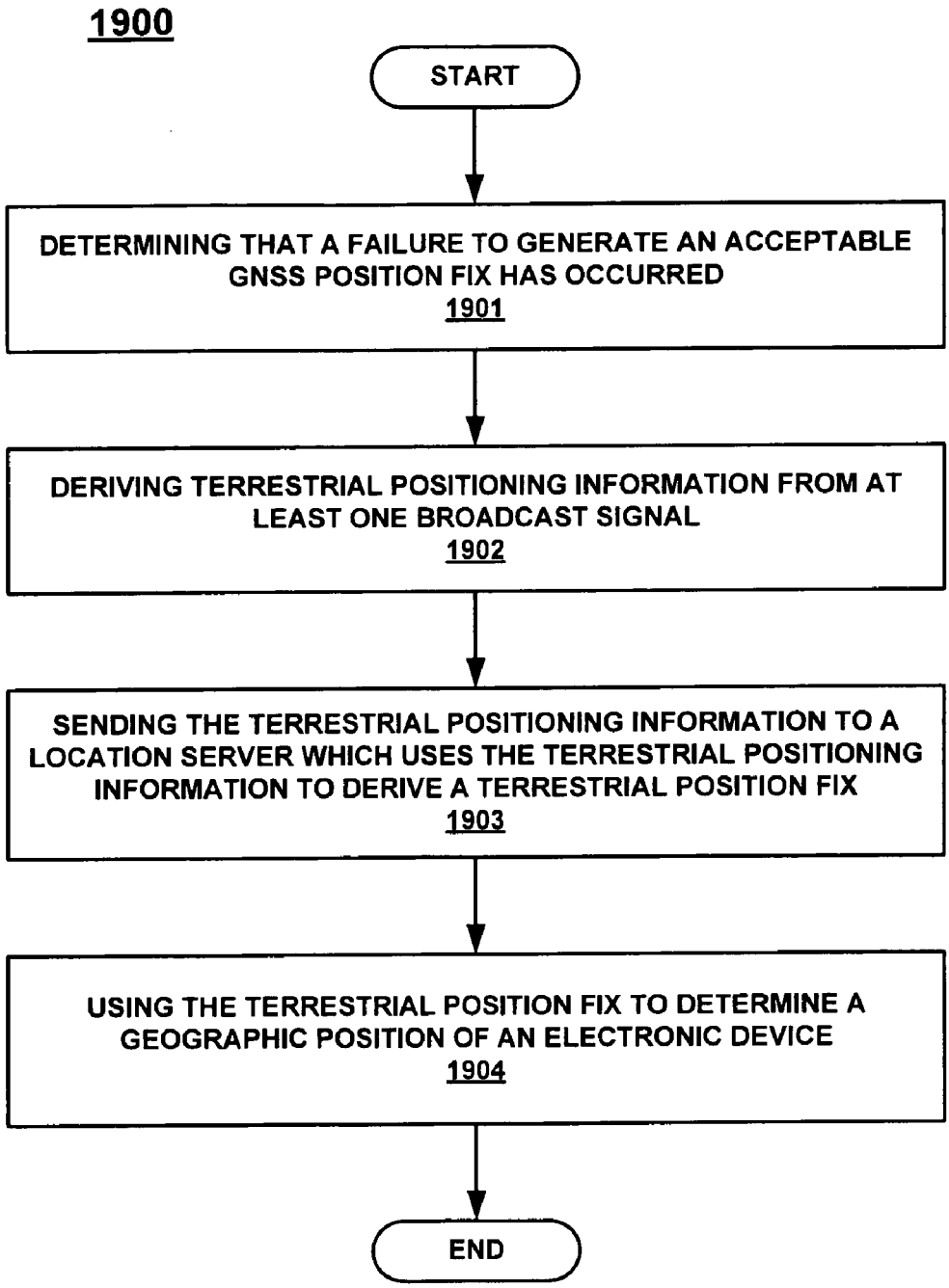
FIG. 19 is a flow chart of a method for controlling an electronic device in accordance with embodiments of the present invention.

FIG. 19 is a flow chart of a method 1900 for controlling an electronic device in accordance with embodiments of the present invention. In block 1901 of FIG. 19, a determination is made that a failure to generate an acceptable GNSS position fix has occurred. With reference to step 1805 of FIG. 18A, embodiments of the present invention determine whether an acceptable position fix can be determined utilizing the plurality of GNSS satellite signals.

In block 1902 of FIG. 19, terrestrial positioning information is derived from at least one broadcast signal upon determining that the failure to generate an acceptable GNSS position fix has occurred. Referring now to step 1806 of FIG. 18B, embodiments of the present invention utilize TV broadcast signals to determine pseudo ranges to the sources of the TV broadcast signals if an acceptable position fix cannot be determined utilizing the plurality of GNSS satellite signals.

In block 1903 of FIG. 19, the terrestrial positioning information is sent to a location server which uses the terrestrial positioning information to derive a terrestrial position fix. In embodiments of the present invention, the pseudo ranges to the TV broadcast sources are sent to TV based location server 905 which uses that information to determine a terrestrial position fix of electronic device 901.

In block 1904 of FIG. 19, the terrestrial position fix is used to determine a geographic position of the electronic device. As discussed above, embodiments of the present invention utilize a Rosum Positioning Technology™ component (e.g., 901 of FIG. 9) to determine a second position fix of an electronic device using television broadcast signals. In embodiments of the present invention, this second position fix may be sent back to the electronic device in order to determine the geographic position thereof. Based upon this geographic position, the operational state of the electronic device may be controlled.

Embodiments of the present invention, an improved position determination system and method, are thus described. While the present invention has been described in particular embodiments, it should be appreciated that the present invention should not be construed as limited by such embodiments, but rather construed according to the following claims.

What is claimed is:

1. A system for controlling an electronic device comprising:

a processor;

a first position determining component coupled with said processor, wherein said first position determining component is a GNSS receiver configured to provide GNSS positioning information; and a second position determining component coupled with said processor, wherein said second position determining component provides terrestrial positioning information derived from at least one terrestrial broadcast signal if said first position determining component fails to determine an acceptable GNSS position fix of said electronic device in at least two dimensions.

2. The system as recited in claim 1 wherein said at least one terrestrial broadcast signal comprises at least one television signal.

3. The system as recited in claim 1 further comprising a communication component coupled to said processor for communicating with a server, and wherein said server processes said terrestrial positioning information to determine a second position fix of said electronic device.

4. The system as recited in claim 1 further comprising a motion detecting component coupled to said processor wherein, upon detecting motion of said electronic device, said processor activates said first position determining component.

5. The system as recited in claim 4 wherein said motion detecting component comprises one or more of a magnetoresistive motion detector, an acceleration sensor, a tilt sensor, a vibration sensor, a rotation sensor, a gyroscope, an interferometer, and an inertia based motion sensor.

6. The system as recited in claim 4 wherein:

upon obtaining said acceptable GNSS position fix, said processor controls an operational state of said electronic device according to said acceptable GNSS position fix; and upon not obtaining said acceptable GNSS position fix, said processor activates said second position determining component to access said at least one terrestrial broadcast signal.

7. The system as recited in claim 6 wherein said processor controls said operational state of said electronic device according to said second position fix upon not obtaining said acceptable GNSS position fix.

8. The system as recited in claim 4 further comprising a latch coupled to said motion detecting component, for latching a motion detection signal thereof.

9. The system as recited in claim 1 wherein said second position determining component is removably coupleable with said electronic device.

10. The system as recited in claim 1 wherein said second position determining component comprises a Rosum Positioning Technology™ component.

11. A method for controlling an electronic device comprising:

determining that a failure to generate an acceptable GNSS position fix has occurred, deriving terrestrial positioning information from at least one broadcast signal in response to said determining;

sending the terrestrial positioning information to a location server which uses the terrestrial positioning information to determine a terrestrial position fix; and using said terrestrial position fix to determine a geographic position of said electronic device.

12. The method as recited in claim 11 wherein said sending further comprises:

sending said terrestrial positioning information to said location server via a wireless communication network.

13. The method as recited in claim 12 further comprising:

receiving said terrestrial position fix from said location server; and controlling an operational state of said electronic device based upon said terrestrial position fix.

14. The method as recited in claim 12 wherein said deriving further comprises:

receiving position aiding information from said location server; and determining a pseudo range to a source of said at least one broadcast signal.

15. The method as recited in claim 12 wherein said sending comprises communicating with said location server using one or more of a telephonic and an internetworking function.

16. The method as recited in claim 11 wherein said deriving terrestrial positioning information derived from at least one broadcast signal comprises:

deriving terrestrial positioning information from at least one television signal.

17. The method as recited in claim 11 wherein said generating said terrestrial position fix further comprises:

utilizing a Rosum Positioning Technology™ system to generate said second position fix.

18. The method as recited in claim 11, further comprising:

detecting a motion of said electronic device; and initiating a GNSS position determining component to determine a position fix of said electronic device in response to said detecting said motion.

19. The method as recited in claim 18 further comprising:

latching a motion detection signal corresponding to said detecting said motion of said electronic device; and validating said motion as significant to said electronic device.

20. The method as recited in claim 18 further comprising:

utilizing a motion detection component selected from the group consisting essentially of magneto-resistive motion detector, an acceleration sensor, a tilt sensor, a vibration sensor, a rotation sensor, a gyroscope, an interferometer, and an inertia based motion sensor.

21. A controllable electronic device, comprising:

a first electronic device comprising:

a processing unit; and a GNSS position determination component coupled with said processing unit for determining an acceptable GNSS position fix; and a second electronic device communicatively coupled with said first electronic device, said second electronic device comprising:

a terrestrial based position determination module communicatively coupled with said processing unit, wherein said terrestrial based position determining module provides terrestrial positioning information derived from at least one terrestrial broadcast signal and is activated in response to a failure of said GNSS position determining component to generate said acceptable GNSS position fix.

22. The controllable electronic device as recited in claim 21 further comprising:

a communication transceiver coupled with said processing unit wherein said position determining transceiver functions to communicatively couple said terrestrial based position determination module to a location server which determines a terrestrial based position fix for said controllable electronic device using the terrestrial positioning information.

23. The controllable electronic device as recited in claim 22 wherein said processor is further for controlling an operational state of said controllable electronic device based upon one of an acceptable GNSS position fix and said terrestrial based position fix.

24. The controllable electronic device as recited in claim 22 wherein:

in response to said failure of said GNSS position determining component to generate said acceptable GNSS position fix said processing unit controls said electronic device according to said terrestrial based position fix.

25. The controllable electronic device as recited in claim 22 wherein said communication transceiver and location server communicate wirelessly via at least one network which supports mobile communication.

26. The controllable electronic device as recited in claim 25 wherein said at least one network is substantially compliant with a standard associated with the Global System for Mobile Communication (GSM).

27. The controllable electronic device as recited in claim 25 wherein communication between said communication transceiver and said at least one network is exchanged using Short Message Service message packets.

28. The controllable electronic device as recited in claim 21 wherein said second electronic device is removably coupleable with said first electronic device and wherein said first electronic device remains partially functional with said second electronic device decoupled therefrom.

29. The controllable electronic device as recited in claim 28 wherein said second electronic device is communicatively coupled with said first electronic device via a serial communication interface.

30. The controllable electronic device as recited in claim 21 wherein said at least one terrestrial broadcast signal comprises a television signal.

31. The controllable electronic device as recited in claim 21 further comprising a motion detector coupled to said processing unit wherein, upon detecting motion of said controllable electronic device, said processing unit activates said GNSS position determination transceiver to access said GNSS positioning information.

32. The controllable electronic device as recited in claim 31 further comprising a latch coupled to said motion detector, for latching a motion detection signal thereof.

33. The controllable electronic device as recited in claim 31 wherein said motion detector comprises one or more of a magneto-resistive motion detecting functionality, an acceleration sensor, a tilt sensor, a vibration sensor, a rotation sensor, a gyroscope, an interferometer, and an inertia based motion sensing functionality.

34. The controllable electronic device as recited in claim 21 wherein said terrestrial based positioning system comprises Rosum Positioning Technology™.

* * * * *